US007401915B2

(12) United States Patent
Sasa et al.

(10) Patent No.: US 7,401,915 B2
(45) Date of Patent: Jul. 22, 2008

(54) IMAGE-RECORDING APPARATUS

(75) Inventors: Masahiko Sasa, Nagoya (JP); Yuji Koga, Nagoya (JP); Masatoshi Izuchi, Nagoya (JP); Shohei Koide, Nagoya (JP); Wataru Sugiyama, Nagoya (JP); Kiyoshi Ueda, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 428 days.

(21) Appl. No.: 11/191,139

(22) Filed: Jul. 28, 2005

(65) Prior Publication Data

US 2006/0023053 A1 Feb. 2, 2006

(30) Foreign Application Priority Data

Jul. 28, 2004 (JP) ..... 2004-220217
Dec. 22, 2004 (JP) ..... 2004-371845
Dec. 22, 2004 (JP) ..... 2004-372141

(51) Int. Cl.
*B41J 2/01* (2006.01)

(52) U.S. Cl. ..... 347/104; 347/101

(58) Field of Classification Search ..... 347/104, 347/101

See application file for complete search history.

(56) References Cited

U.S. PATENT DOCUMENTS 5,580,042 A * 12/1996 Taniguro et al. ..... 271/274
6,032,949 A * 3/2000 Ando ..... 271/225
6,382,857 B1 * 5/2002 Yanagi et al. ..... 400/636
6,712,463 B2 * 3/2004 Matsumoto ..... 347/104
6,817,609 B2 * 11/2004 Halvonik et al. ..... 271/228
2002/0126193 A1 * 9/2002 Maki et al. ..... 347/104
2003/0128373 A1 * 7/2003 Hayashi et al. ..... 358/1.1
2004/0178571 A1 9/2004 Ohama et al.
2004/0207707 A1 * 10/2004 Ohashi et al. ..... 347/104
2005/0195263 A1 * 9/2005 Marra et al. ..... 347/104
2006/0077245 A1 * 4/2006 Tsutsui ..... 347/104

FOREIGN PATENT DOCUMENTS

JP 9300758 11/1997
JP 2001341909 12/2001
JP 2002128312 5/2002
JP 2002226077 8/2002
JP 2004277089 10/2004

* cited by examiner

*Primary Examiner*—Manish S Shah
(74) *Attorney, Agent, or Firm*—Banner & Witcoff, Ltd.

(57) ABSTRACT

A plurality of nip rollers are provided under a driving roller approximately in a direction of a drive shaft of the driving roller. Respective shafts of the nip rollers are arranged so that the rotary shafts are inclined toward a downstream side in a transport direction of a recording medium with respect to the drive shaft of the driving roller. Nip positions for the recording medium, formed by the nip rollers and the driving roller, are positioned on an upstream side in the transport direction above the lowermost end portion of the outer circumference of the driving roller. Therefore, the recording medium is transported at a satisfactory accuracy in an image-recording section, thereby avoiding the deterioration of the recording quality which would be otherwise caused by the positional deviation of the recording on the recording medium.

33 Claims, 21 Drawing Sheets

IMAGE-RECORDING APPARATUS

CROSS REFERENCE TO RELATED APPLICATIONS

This application claims priority to Japanese patent application Nos. 2004-220217, filed Jul. 28, 2004; 2004-371845, filed Dec. 22, 2004; and 2004-372141, filed Dec. 22, 2004, the contents of which are incorporated herein by reference.

BACKGROUND OF THE INVENTION

1. Field of the Invention

The present invention relates to an image-recording apparatus in which a recording medium is interposed by a driving roller and nip rollers provided at opposing positions on a transport passage respectively and is transported to an image-recording section, where an image is recorded on the recording medium, arranged on the downstream side of the driving roller and the nip rollers.

2. Description of the Related Art

FIG. 21 shows an arrangement around an image-recording section of a conventional image-recording apparatus. As shown in the drawing, a recording head 91, which discharges the ink while being subjected to the scanning in the widthwise direction of the recording paper, is provided over a transport passage 90 so that the scanning can be performed. A platen 92, which supports the recording paper during the recording, is arranged under the transport passage 90 which is opposed to the recording head 91. A driving roller 93 and nip rollers 95 are provided on the upstream side of the recording head 91 in the transport direction of the recording paper, and a paper discharge roller 94 and spur rollers 96 are provided on the downstream side, while the rollers are disposed as pairs at positions opposed to the transport passage 90. The driving force is transmitted to the driving roller 93 and the paper discharge roller 94 from a driving source (not illustrated) such as a motor via gears or the like. On the other hand, the nip rollers 95 and the spur rollers 96 are arranged so that they are movable upwardly and downwardly. The nip rollers 95 and the spur rollers 96 are urged by springs or the like toward the driving roller 93 or the paper discharge roller 94 respectively to make contact with the driving roller 93 or the paper discharge roller 94 under the pressure.

The recording paper P, which is transported by a transport means from a printing paper tray (not illustrated), is transported onto the platen 92 by being interposed by the driving roller 93 and the nip rollers 95 disposed on the upstream side. When the forward end of the recording paper P arrives at the position under the recording head 91, the scanning of the recording head 91 is started. The ink is discharged from the recording head 91 onto the recording paper P. The driving roller 93 and the nip rollers 95 are driven intermittently by a predetermined line feed amount. Every time when the driving roller 93 and the nip rollers 95 are driven intermittently, the recording head 92 is subjected to the scanning. This operation is repeated, and thus an image is recorded in a predetermined area of the recording paper P transported by every predetermined line feed amount. When the forward end of the recording paper P arrives at the paper discharge roller 94 and the spur rollers 96 disposed on the downstream side, the image recording is performed in such a state that the recording paper P is interposed at the forward end portion thereof by the paper discharge roller 94 and the spur rollers 96, and the recording paper P is interposed at the rearward end portion by the driving roller 93 and the nip rollers 95. When the recording paper P is interposed by the rollers on the upstream side and the downstream side of the recording head 91 respectively as described above, an appropriate tensile force is exerted onto the recording paper P. When the ink droplets, which are discharged from the recording head 91, are landed on the recording paper P, then the solvent of the ink droplets is immediately evaporated, and the shrinkage occurs in the recording paper P. However, the recording paper P on the platen 92 is maintained to be flat by the tensile force as described above. When the recording paper P is further transported, the rearward end of the recording paper P passes out of the driving roller 93 and the nip rollers 95. The recording paper P is transported by the paper discharge roller 94 and the spur rollers 96 disposed on the downstream side. When the image recording is completed, the recording paper P passes out of the paper discharge roller 94 and the spur rollers 96 as well. The recording paper P is discharged to a paper discharge tray (not illustrated).

FIG. 22 shows a plan view illustrating the driving roller 93 and the nip rollers 95 arranged on the upstream side of the recording head 91. As shown in the drawing, the four nip rollers 95, which are disposed at predetermined intervals in the axial direction, are provided in array for one driving roller 93. The shaft of the driving roller 93 is parallel to the shafts of the respective nip rollers 95. As shown by hatched lines in the drawing, the driving roller 93 and the respective nip rollers 95 make contact under the pressure respectively in linear areas disposed in parallel to the shafts to form nip positions N. Therefore, the recording paper P is interposed by the driving roller 93 and the nip rollers 95 at the four linear nip positions N. However, when the recording paper P passes over the respective nip positions N, then the interposing forces, which are exerted by the driving roller 93 and the nip rollers 95, are released at once, and the urging forces of the respective nip rollers 95 are applied to the rearward end of the recording paper P. Accordingly, the recording paper P is pushed out in the transport direction.

On the other hand, as shown in FIG. 21, the spur rollers 96, which are arranged on the downstream side of the recording head 91, make direct contact with the recording surface of the recording paper P immediately after the landing of the ink droplets. Therefore, if the spur rollers 96 are pressed strongly toward the paper discharge roller 94, a problem arises, for example, such that any trace remains on the recording surface. Therefore, any strong pressing force should not be applied to the spur rollers 96. Therefore, it is inevitable that the interposing forces, which are exerted by the paper discharge roller 94 and the spur rollers 96, are made to be weak. When the pushing force is generated when the recording paper P passes over the nip positions N formed by the driving roller 93 and the nip rollers 95 as described above, the pushing force cannot be restrained by the interposing force for the recording paper P exerted by the paper discharge roller 94 and the spur rollers 96. Therefore, a problem of the so called "overfeed" arises such that the recording paper P is transported by an amount not less than the predetermined line feed amount by the pushing force as if the recording paper P slides out the nip positions formed by the paper discharge roller 94 and the spur rollers 96. If the overfeed occurs, a problem arises such that the recording position is deviated in the secondary scanning direction, and any unevenness and/or white blank appears in the recorded image.

A structure as shown in FIG. 23A is known as a countermeasure to solve the problems as described above (see Japanese Patent Application Laid-open No. 2002-226077). In this structure, a driving roller 97 having a large diameter is provided on the upstream side of the recording head 91. On the other hand, two nip rollers 98, each of which has a diameter smaller than that of the driving roller 97 and each of which is formed to have a large diameter section and a small diameter section in a tapered form, are provided as a pair. The pair of nip rollers 98 are arranged coaxially so that the respective large diameter sections are positioned at the both ends to provide one roller set 99. The four roller sets 99 are provided in array at predetermined intervals in the axial direction of the driving roller 97. The shaft of each of the roller sets 99 is arranged by being inclined by a predetermined angle with respect to the shaft of the driving roller 97. The angles of inclination of the two roller sets 99 arranged at the both ends are larger than the angles of inclination of the two roller sets 99 arranged at the central portions of the driving roller 97. Accordingly, the nips at the nip positions N between the driving roller 97 and the respective nip rollers 98 are formed as points, and the positions in the transport direction are deviated from each other. Therefore, the timings, at which the recording paper P passes over the respective nip positions N, are deviated from one another. The recording paper P, which is interposed by the driving roller 97 and the nip rollers 98, is released in a stepwise manner. The overfeed of the recording paper P is suppressed.

According to Japanese Patent Application Laid-open No. 2002-226077, it is disclosed that the nip rollers and the driving roller are arranged in the relationship as shown in FIG. 23B (corresponding to FIG. 4(*b*) of Japanese Patent Application Laid-open No. 2002-226077). The nip roller (pinch roller) 98 is rotatably attached to a rotary shaft provided on a holder (not illustrated). As described above, the rotary shaft of the nip roller 98 is attached while being inclined by the predetermined angle with respect to the rotary shaft of the driving roller 97. The holder is urged by a spring, and thus the nip roller 98 is pressed against the upper portion of the driving roller 97. The large diameter sections 98*a*, 98*d* of the nip roller 98 make contact with the driving roller 97 under the pressure to form the nips. In this situation, both of the nip position formed by the large diameter section 98*a* and the driving roller 97 and the nip position formed by the large diameter section 98*d* and the driving roller 97 are positioned on the lower side and on the downstream side in the transport direction as compared with the uppermost end of the driving roller 97. As shown in FIG. 23B, the nip position formed by the large diameter section 98*d* and the driving roller 97 is positioned on the further downstream side in the transport direction as compared with the nip position formed by the large diameter section 98*a* and the driving roller 97. Therefore, in the case of the structure described in Japanese Patent Application Laid-open No. 2002-226077, the recording medium is disengaged from the nip positions in a stepwise manner while the rearward end passes over the uppermost end portion of the driving roller to move downwardly in a state in which the forward end of the recording medium is transported on the transport passage while being interposed by the roller set disposed on the downstream side of the image-recording section. That is, the position, at which the contact of the recording medium with the nip roller and the driving roller comes to the end, is coincident with the nip position formed by the large diameter section 98*d* and the driving roller 97. Therefore, the rearward end of the recording medium becomes immediately in a free state after being disengaged from the nip position in a state of being urged in the downward direction. Therefore, the rearward end of the recording medium tends to float upwardly. When the rearward end floats upwardly, then the flatness of the entire recording medium is deteriorated, and any uniform spacing distance is not formed between the recording medium and the recording head in the image-recording section. Therefore, a problem arises such that the recording quality is deteriorated.

In Japanese Patent Application Laid-open No. 2002-226077, the nip positions, which are formed by the large diameter sections of the nip roller and the driving roller, are deviated in the transport direction, and the recording medium is transported while being positionally adjusted on one end edge side in the transport direction. Therefore, when any recording medium, which has a non-standard size in the widthwise direction, is interposed, the nip positions are not symmetrical in the widthwise direction of the recording medium, resulting in the deviation, in the transport direction, of the nip positions and the contact start positions of the driving roller and the nip roller with respect to the recording medium. Therefore, there has been such a possibility that the recording medium may be transported while being inclined with respect to the transport direction.

As described above, the outer diameter of each of the nip rollers 98 is changed in the tapered form in the axial direction, and the shaft or the axis thereof is inclined with respect to the driving roller 97. Further, the nip roller 98 is rotatably attached to the rotary shaft provided in the holder urged by the spring, which is pressed by the driving roller 97. It is considered that the nip positions N, at which the respective nip rollers 98 of one roller set 99 make contact with the driving roller 97 under the pressure, are not the left-right symmetrical positions in some cases with respect to the axis perpendicular to the shaft of the roller set 99 depending on the positions of the respective nip rollers 98 with respect to the driving roller 97. In such a situation, the speeds of rotation of the nip rollers 98 driven by the rotation of the driving roller 97 are not identical on the left and right sides, because the diameters of the nip rollers 98 at the nip positions are different between the left and right rollers. In order to respond to the situation as described above, it is necessary that the left and right nip rollers 98 should be rotated independently. When the left and right nip rollers 98 can be freely rotated with respect to the shaft of the roller set 99 as in Japanese Patent Application Laid-open No. 2002-226077, the respective nip rollers 98 are movable in the axial direction as well, and there is such a possibility that the spacing distance between the nip positions N of one roller set 99 may be varied. In this case, a problem is considered to arise such that it is difficult to correctly establish the respective nip positions N in the transport direction. On the other hand, in order that the left and right nip rollers 98 are fixed to the shaft of the roller set 99 to obtain the same rotation on the left and right sides, it is necessary that any constant tapered shape is provided so that the outer diameters of the respective nip rollers 98 are in the left-right symmetrical in each roller set 99, and the positioning should be effected with respect to the driving roller 97 so that the rotation is identical on the left and right sides. Consequently, a problem arises such that it is complicated to produce the nip rollers 98 and assemble the driving roller 97 and the respective roller sets 99.

When the nip roller is rotatably supported by the rotary shaft (support shaft) provided on the holder (pinch roller holder), and the holder is pressed by the spring toward the driving roller as in Japanese Patent Application Laid-open No. 2002-226077, then the reaction force of the pressing force acts on the bearing section of the support shaft. However, in general, the holder and the nip roller are made of synthetic resin materials such as ABS, and the support shaft of the nip roller is made of metal (steel material). Therefore, the following problem arises. That is, when the nip roller and the support shaft are rotated in an integrated manner during the transport of the recording medium, then the bearing portion made of synthetic resin is cut or scraped, and backlash is caused. If the bearing section is greatly cut or scraped, then the axial center position of the support shaft is deviated away from the driving roller, and the holder surface (transport surface) relatively abuts against the outer circumferential surface of the driving roller. Therefore, this causes a paper jam. When the driving roller is made of a hard material, the surface of the holder is cut or scraped.

Even when a lubricant such as grease is applied to the bearing section in order to solve the problem as described above, the paper powder acts as a polishing material, when the paper powder originating from the recording medium is mixed into the grease. A problem arises such that the bearing section is increasingly cut or scraped. Further, the following problem also arises. That is, when the grease is applied to the bearing section, for example, the grease is liquefied to adhere and stain the recording medium, when the environmental temperature is raised.

It is also conceived that a part of the outer circumference at the end of the support shaft is formed to have a D-shaped cross section in order to solve the problem as described above. However, when the diameter of the support shaft is small, it is difficult to perform the processing or the machining therefor. Further, it is necessary that a D-shaped hole should be also formed for the bearing section. Problems arise such that the production cost is also expensive, and the operation for incorporating the support shaft into the bearing section is troublesome as well.

SUMMARY OF THE INVENTION

The present invention has been made taking the foregoing problems into consideration, an object of which is to provide a means for avoiding the deterioration of a recorded image formed by an image-recording apparatus by suppressing the overfeed of a recording medium conveniently and reliably. Another object of the present invention is to provide an image-recording apparatus in which the feed accuracy for a recording medium is satisfactory in an image-recording section, and which is capable of avoiding the deterioration of the recording quality which would be otherwise caused by the positional deviation of the recording with respect to the recording medium. Still another object of the present invention is to provide an image-recording apparatus which is cheap and in which nip rollers are smoothly rotated, any damage such as cutting of a bearing section is eliminated, which is capable of reliably transporting a recording medium in an image-recording section, and the assembling performance is satisfactory.

According to the present invention, there is provided an image-recording apparatus which records an image on a recording medium. The image-recording apparatus comprises: an image-recording section which records the image on the recording medium; a transport passage which transports the recording medium to the image-recording section; and a driving roller and a plurality of nip rollers which are provided on the transport passage respectively to interpose and transport the recording medium. In the image-recording apparatus, shafts of the plurality of nip rollers are arranged substantially along a drive shaft of the driving roller under the driving roller, the shafts being inclined toward a downstream side in a transport direction of the recording medium with respect to the drive shaft of the driving roller; and nip positions for the recording medium, which are formed by the nip rollers and the driving roller, are positioned above and upstream, in the transport direction, from a lowermost end portion of an outer circumference of the driving roller.

According to the present invention, the rotary shafts of the nip rollers are arranged while being inclined with respect to the drive shaft of the driving roller, and the recording medium is interposed (nipped) by the nip rollers and the driving roller at a plurality of points of the same number as the number of the nip rollers. Therefore, the force, which acts to excessively push out or extrude the recording medium in the transport direction when the interposed state is released, can be decreased as compared with a case in which the recording medium is interposed by the line-to-line contact in the widthwise direction.

According to the present invention, the respective nip positions are positioned above the lowermost end portion of the outer circumference of the driving roller on the upstream side in the transport direction. The position, at which the contact of the recording medium with the nip roller and the driving roller comes to the end, is disposed on the downstream side from the nip position. Therefore, the rearward end of the recording medium is further guided to the position below the nip position along the outer circumference on the lower end side of the driving roller, and the contact with the driving roller comes to the end, after the rearward end is disengaged from the nip position. Therefore, the recording medium is transported while the upward floating of the rearward end is suppressed. The flatness is maintained for the entire surface. As a result, it is possible to realize the highly accurate transport in which the recording quality achieved by the image-recording section is not deteriorated.

In the image-recording apparatus of the present invention, one of both ends of each of the shafts of the nip rollers, which is disposed on a side close to a substantially central portion of the transport passage in a widthwise direction perpendicular to the transport direction, may be arranged to incline so that the one end is positioned in a downstream of the other end in the transport direction. In this arrangement, the nip rollers are rotated toward the both side ends in the longitudinal direction of the transport direction during the transport, and the tensile force is exerted on the recording medium so that the both side ends are pulled thereby. Therefore, the recording medium can be transported to the image-recording section while avoiding the occurrence of, for example, the wrinkle and the bending in the vicinity of the substantially central portion of the recording medium.

In the image-recording apparatus of the present invention, the nip rollers may be arranged to be symmetrical with respect to a substantially central portion in a widthwise direction of the transport passage. In this arrangement, the recording medium is interposed in a well-balanced manner in the widthwise direction.

In the image-recording apparatus of the present invention, each of the nip rollers may have such a contour that a predetermined area, which includes the nip position in an axial direction of the nip roller, is formed to have an identical diameter. In this arrangement, an effect is obtained such that the positional adjustment is easily performed with respect to the driving roller when the nip position is established, as compared with a case in which the contour of the nip roller is formed to have a tapered shape.

In the image-recording apparatus of the present invention, a rubber-like elastic member may be formed at least at the nip position on at least one of an outer circumference of the driving roller and outer circumferences of the nip rollers. In this arrangement, the rubber-like elastic member is subjected to the compressive deformation, and thus the surface-to-surface contact, which is effected in a curved surface form, is brought about within a slight range at the plurality of nip positions respectively. Therefore, when the recording medium is disengaged from the nip positions, the interposed state is released gradually and gently at the respective nip positions, in addition to the effect brought about by the release from the interposed state based on the plurality of points (nip positions) as described above. Therefore, the effect is enhanced to suppress the generation of the force for excessively push out the recording medium.

In the image-recording apparatus of the present invention, at least two nip rollers of the nip rollers may be arranged to incline in an identical direction, and axes of the shafts of the at least two nip rollers may be arranged in parallel in a plane substantially parallel to the transport passage. In this arrangement, the space, which is occupied in the transport direction in the arrangement of the nip rollers, can be decreased as compared with a case in which the rotary shafts of the nip rollers are arranged on an identical axis.

In the image-recording apparatus of the present invention, the recording medium may be transported such that a substantially central portion in a widthwise direction of the recording medium is positionally adjusted to the substantially central portion in the widthwise direction of the transport passage. In this arrangement, the effect is synergistically obtained by the fact that the nip rollers are arranged while the both sides are symmetrical about the center of the substantially central portion in the widthwise direction of the transport passage. Even when the size of the recording medium in the widthwise direction differs, the recording medium can be always interposed and transported in a well-balanced manner in the widthwise direction.

In the image-recording apparatus of the present invention, the nip positions, which are formed by the driving roller and the nip rollers arranged to incline in the identical direction, may be positioned on an identical straight line extending perpendicularly to the transport direction. In this arrangement, even when the size in the widthwise direction of the recording medium to be transported differs, and the size is outside the standard size, then the interposing operation can be always started at the same position in the transport direction for the forward end of the recording medium, and the recording medium can be always interposed and transported in a well-balanced manner in the widthwise direction.

In the image-recording apparatus of the present invention, the recording medium may be transported to the nip positions via a U-turn transport passage from a position lower than the nip positions. In this arrangement, even when the recording medium is transported while lifting up the recording medium from the lower position via the U-turn transport passage, in other words, even when the relatively large nipping force is required between the driving roller and the nip rollers, then the recording medium is released from the interposed state between the driving roller and the nip rollers, while the recording medium is not transported excessively. Therefore, it is possible to realize the highly accurate transport to the image-recording section.

In the image-recording apparatus of the present invention, a recessed cutout may be formed on each of the nip rollers, and nip sections, which make contact with the driving roller under pressure respectively, may be formed on both sides of the recessed cutout in an axial direction respectively. In this embodiment, the recording medium is transported while being interposed between the driving roller and each of the nip rollers at two positions in the transport direction, owing to the fact that the recessed cutout is formed on each of the nip rollers, and the nip sections, which make contact with the driving roller under the pressure respectively, are formed on the both sides of the recessed cutout in the axial direction respectively, wherein the plurality of nip rollers are provided in array while their axes are inclined by predetermined angles in the transport direction with respect to the axis of the driving roller. Accordingly, the nip pressure, which is exerted between the nip roller and the driving roller, is dispersed. Further, when the rearward end of the recording medium passes, the interposed state, which is effected by the nip roller and the driving roller, is released in a divided manner at the two positions. Therefore, the force to push out the recording medium in the transport direction is weakened when the recording medium is released from the interposed state effected by the nip roller and the driving roller. Thus, it is possible to suppress the overfeed of the recording medium. Therefore, it is possible to realize the image-recording apparatus in which the image is hardly disturbed in the vicinity of the rearward end of the recording medium.

In the image-recording apparatus of the present invention, the driving roller may be driven intermittently by a predetermined unit of transport distance at least when the recording medium is transported while being interposed at portions disposed in the vicinity of a rearward end of the recording medium; and a spacing distance in the transport direction between the respective nip positions, at which the respective nip sections of the respective nip rollers and the driving roller make contact under pressure, may be not less than the unit of transport distance. In this arrangement, the driving roller is necessarily driven intermittently when the rearward end of the recording medium is positioned between the respective nip positions of the nip rollers, because the driving roller is driven intermittently by the unit of transport distance at least when the portions in the vicinity of the rearward end of the recording medium are transported, and the spacing distance in the transport direction between the respective nip positions at which the respective nip sections of the respective nip rollers and the driving roller make contact under the pressure is not less than the unit of transport distance. Accordingly, the timings, at which the two portions in the vicinity of the rearward end of the recording medium interposed by the respective nip rollers and the driving roller are released respectively, can be reliably divided or separated. The pushing force, which is exerted when the interposed state on the upstream side in the transport direction is released, can be suppressed by the interposed state effected on the downstream side in the transport direction.

In the image-recording apparatus of the present invention, the respective nip sections of the respective nip rollers may have an identical diameter. In this arrangement, it is easy to perform the positional adjustment for the nip roller which make contact with the driving roller under the pressure at the two positions, because the respective nip sections of the respective nip rollers are formed to have the same diameter.

In the image-recording apparatus of the present invention, the nip positions, at which the respective nip sections of the respective nip rollers and the driving roller make contact under pressure, may include an upstream side nip position group and a downstream side nip position group in the transport direction, nip positions, which are included in the upstream side nip position group, may be positioned on a first straight line perpendicular to the transport direction, and nip positions, which are included in the downstream side nip position group, may be positioned on a second straight line perpendicular to the transport direction. In this arrangement, the advantage is obtained, for example, such that when the forward end of the recording medium is allowed to abut against the driving roller to correct any oblique or inclined transport, the abutment position can be made to be an identical position in the transport direction, while the forward end of the recording medium is interposed at the simultaneous timing as well, and hence the recording medium is transported without causing any oblique transport, because the respective nip positions, at which the respective nip sections of the respective nip rollers and the driving roller make contact under the pressure, are positioned on the identical straight lines in the direction perpendicular to the transport direction in relation to the respective nip position groups, i.e., the nip position group disposed on the upstream side in the transport direction and the nip position group disposed on the downstream side.

In the image-recording apparatus of the present invention, the respective nip rollers may be arranged, corresponding to sizes of various recording media to be transported, in the vicinity of both ends in a widthwise direction of the recording media. In this arrangement, it is possible to interpose and transport the various types of the recording media in a well-balanced manner, because the respective nip rollers are arranged in the vicinity of the both ends in the widthwise direction of the various recording media corresponding to the sizes of the plurality of type of the recording media to be transported.

In the image-recording apparatus of the present invention, the nip rollers may be arranged left-right symmetrically with respect to a center of the transport passage in a widthwise direction. In this arrangement, the various recording media, which are to be transported on the basis of the center, can be interposed and transported in a well-balanced manner, which is especially useful having the size other than the standardized size, because the respective nip rollers are arranged left-right symmetrically with respect to the center of the transport passage in the widthwise direction.

In the image-recording apparatus of the present invention, each of the shafts of the respective nip rollers may be arranged to incline so that one end, which is disposed on a side of a center in a widthwise direction of the transport passage, is positioned in a downstream of the other end in the transport direction. In this arrangement, the tensile force, which is spread toward the outside of the widthwise direction, acts on the recording medium transported while being interposed by the driving roller and the respective nip rollers, because each of the shafts of the respective nip rollers is arranged and inclined so that the end, which is disposed on the side of the center in the widthwise direction of the transport passage, is disposed on the downstream side in the transport direction. Accordingly, it is possible to avoid the occurrence of, for example, the bending and the wrinkle on the recording medium.

In the image-recording apparatus of the present invention, the upstream side of the transport passage from the driving roller and the nip rollers may guide the recording medium to the nip positions from a position below the nip positions formed by the driving roller and the nip rollers. Further, in the image-recording apparatus of the present invention, the transport passage may guide the recording medium by subjecting the recording medium to a U-turn from a lower position to an upper position. These features are especially useful when the large interposing forces are required for the driving roller and the nip rollers in order to transport the recording medium upwardly by the transport forces of the driving roller and the nip rollers, in which the pushing force is strengthened when the interposed state is released, assuming that the transport passage, which is disposed on the upstream side from the driving roller and the nip rollers, guides the recording medium to the nip positions from positions below the nip positions formed by the driving roller and the nip rollers, especially when the transport passage guides the recording medium by subjecting the recording medium to the U-turn from the lower position to the upper position.

In the image-recording apparatus of the present invention, the image-recording section may include an ink-jet recording head which records the image by discharging an ink. This feature is especially useful when the overfeed, which is caused when the rearward end of the recording medium is transported by the driving roller and the nip rollers, deteriorates the image, assuming that the image-recording section includes the ink-jet recording head which records the image by discharging the ink.

In the image-recording apparatus of the present invention, only one nip roller may be provided for the shaft thereof. In this arrangement, the roller can be positioned with ease, because only one roller is provided for the shaft of the nip roller.

In the image-recording apparatus of the present invention, the recessed cutout of the nip roller may be a cylindrical groove which is perpendicular to the axial direction of the nip roller. In this arrangement, the nip roller can be processed or machined with ease, because the shape of the recessed cutout is simple.

In the image-recording apparatus of the present invention, the recessed cutout of the nip roller may be a groove which is formed obliquely with respect to the axial direction of the nip roller. In this arrangement, the nip positions, which are disposed at the both ends of the nip roller, are gradually changed depending on the rotation of the roller. Therefore, when the plurality of nip rollers are arranged while being inclined with respect to the drive shaft of the driving roller along with the drive shaft of the driving roller below the driving roller, the nip positions of the respective rollers differ for each of the rollers in the direction perpendicular to the transport direction of the recording medium. Accordingly, the timings, at which the recording medium is released from the interposed state, are dispersed. The force to push out or extrude the recording medium is appropriately adjusted.

The image-recording apparatus of the present invention may further comprise support shafts each of which rotatably supports one of the nip rollers; and bearing sections which support both ends of each of the support shafts and which include a first bearing section which supports an upstream side portion and a downstream side portion, in the transport direction of the recording medium, of an outer circumferential surface disposed at the both ends of the support shaft, and a second bearing section which supports the both ends of the support shaft to prevent any disengagement. In the image-recording apparatus, a shaft rotation stop member may be fitted to at least one end of the support shaft, and the shaft rotation stop member may be restricted by the second bearing section. In this arrangement, the bearing-section includes the first bearing section which supports the side surfaces on the upstream side and the downstream side in the transport direction of the recording medium, of the outer circumference disposed at each of the both ends of the support shaft which rotatably supports the nip roller, and the second bearing section which supports the both ends of the support shaft to prevent any disengagement of the support shaft; wherein the shaft rotation stop member is fitted to at least one end of the support shaft, and the shaft rotation stop member is restricted by the second bearing section. Therefore, the support shaft, to which the shaft rotation stop member is attached, cannot be rotated with respect to the second bearing section. Therefore, the following effect is obtained. That is, only the nip roller is smoothly rotated, and it is possible to eliminate any damage such as the cutting or the scraping of the bearing section. The recording medium can be transported reliably, and the quality of the image recording is not deteriorated.

In the image-recording apparatus of the present invention, the shaft rotation stop member may have a shape to be tightly fitted to the support shaft. In this arrangement, the structure is simple, in which one shaft rotation stop member is merely fitted to at least one end of the support shaft, because the shaft rotation stop member is constructed to have the shape to be fitted to the support shaft by means of the tight fit. It is unnecessary to apply any forming processing or machining to the support shaft. The production cost is not increased so much. Further, even in the operation for incorporating the nip roller as well as the support shaft into the bearing section, one end portion of the support shaft, which is disposed on the side of the attachment of the shaft rotation stop member, is first fitted to the second bearing section. Therefore, an effect is also obtained such that the incorporating operation performance is satisfactory.

In the image-recording apparatus of the present invention, the first bearing section may be disposed on a side close to an end surface of the nip roller, the second bearing section may be arranged on a side far from the end surface of the nip roller with the first bearing section intervening therebetween, and the second bearing section may include a pair of fastening pawls which fasten the shaft rotation stop member. In this arrangement, the support shaft cannot be disengaged from the bearing section by the simple operation in which one end portion of the support shaft on the side of the attachment of the shaft rotation stop member is first fitted into the second bearing section, and then the support shaft is returned to be in the horizontal state, because the first bearing section is disposed on the side close to the end surface of the nip roller, the second bearing section is arranged on the side far from the end surface of the nip roller with the first bearing section intervening therebetween, and the second bearing section includes the pair of fastening pawls which fasten the shaft rotation stop member. An effect is obtained such that the incorporating operation performance is more satisfactory.

In the image-recording apparatus of the present invention, the first bearing section and the second bearing section may be integrally formed in a guide member which constructs the transport passage. In this arrangement, an effect is obtained such that the structure is simplified, because the first bearing section and the second bearing section are integrally formed in the guide member for constructing the transport passage.

In the image-recording apparatus of the present invention, the nip roller and the shaft rotation stop member may be composed of synthetic resin materials, and the support shaft may be made of metal. In this arrangement, the support shaft cannot be rotated owing to the shaft rotation stop member, and the bearing section is not cut or scraped, because the nip roller and the shaft rotation stop member are composed of synthetic resin materials, and the support shaft is made of metal. Therefore, an effect is obtained such that the posture of the nip roller is not changed, and the transport operation for the recording medium is not deteriorated by any aging or secular change.

In the image-recording apparatus of the present invention, the shaft rotation stop member may be made of a material which has a high coefficient of friction with respect to the support shaft. In this arrangement, when the shaft rotation stop member is composed of the material which has the high coefficient of friction with respect to the support shaft, an effect is obtained such that the shaft rotation stop member is prevented from relative rotation with respect to the both of the support shaft and the second bearing member.

In the image-recording apparatus of the present invention, the shaft rotation stop member may have a flat shape and may be made of metal provided with an insertion hole capable of inserting the support shaft thereinto, and a plurality of annular projections, which are bent inwardly, may be arranged for the insertion hole, and forward ends of the respective projections may reach an outer circumferential surface of the support shaft so that the forward ends are tightly fitted to the support shaft. In this arrangement, the shaft rotation stop member, which has the flat shape made of metal, is tightly fixed to the support shaft, because the shaft rotation stop member has the flat shape made of metal provided with an insertion hole capable of inserting the support shaft thereinto, and the plurality of annular projections, which are bent inwardly, are arranged for the insertion hole, and the forward ends of the respective projections arrive at the outer circumferential surface of the support shaft so that the forward ends are fitted to the support shaft by means of tight fit. Therefore, the shaft rotation stop member may be fixed to an appropriate portion of the bearing or the support section for the nip roller so that any rotation cannot be effected.

In the image-recording apparatus of the present invention, the shaft rotation stop member may have a flat shape and may be made of metal, and the shaft rotation stop member may have a tongue which is fitted to an open groove of the second bearing section to stop rotation of the support shaft. In this arrangement, an effect is obtained such that the shape of the shaft rotation stop member is made to be extremely small, and the effect to stop the rotation of the support shaft is not deteriorated as well, because the shaft rotation stop member has the flat shape and is made of metal, and the shaft rotation stop member has the tongue which is fitted to the open groove of the second bearing section to stop rotation of the support shaft.

In the image-recording apparatus of the present invention, one of both ends of each of the support shafts of the plurality of nip rollers, which is disposed on a side close to a substantially central portion in a widthwise direction perpendicular to the transport direction of the transport passage, may be arranged to incline so that the one end is positioned in a downstream of the other end in the transport direction. In this arrangement, the effect is synergistically obtained by the fact that the nip rollers are arranged while the both sides have the symmetrical shapes with the center of the substantially central portion in the widthwise direction of the transport direction. Even when the size of the recording medium in the widthwise direction differs, the recording medium can be always transported by interposing the recording medium in a well-balanced manner in the widthwise direction.

In the image-recording apparatus of the present invention, the nip rollers may be arranged left-right symmetrical with respect to the center of the substantially central portion in the widthwise direction of the transport passage. In this arrangement, even when the size of the recording medium to be transported differs, and the size is outside the range of the standard size, then the interposing operation can be always started at the same position in the transport direction for the forward end of the recording medium, and the recording medium can be always interposed in the widthwise direction and transported in a well-balanced manner.

The image-recording apparatus of the present invention may further comprise a paper feed cassette, and a paper feed unit which feeds the recording media accumulated in the paper feed cassette to the transport passage. In this arrangement, a large number of sheets of the recording medium are prepared in the paper feed cassette, and thus the recording medium can be continuously supplied to the transport passage.

DESCRIPTION OF THE PREFERRED EMBODIMENTS

First Embodiment

Figure 1:
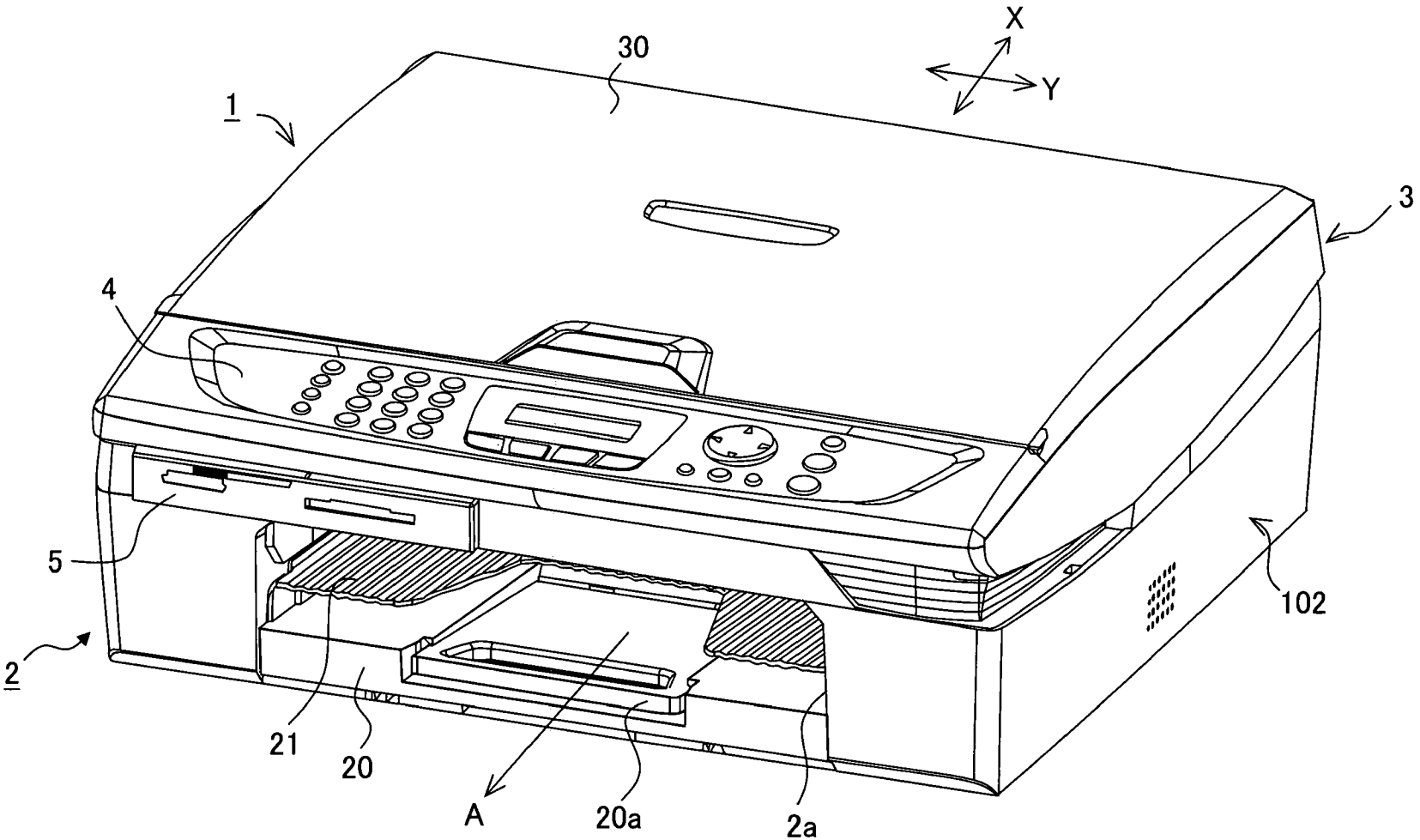
FIG. 1 shows a perspective view illustrating an appearance of an image-recording apparatus 1 according to an embodiment of the present invention.

An embodiment of the image-recording apparatus of the present invention will be explained with reference to the drawings. FIG. 1 shows an appearance of an image-recording apparatus 1 according to the embodiment of the present invention. This image-recording apparatus 1 is a multifunction device (MFD) integrally comprising a printer section 2 disposed on the lower side and a scanner section 3 disposed on the upper side. The image-recording apparatus 1 has the printer function, the scanner function, and the copy function. The printer section 2, which is included in the image-recording apparatus 1, corresponds to the image-recording apparatus according to the present invention. The functions other than the printer function are arbitrarily provided. Therefore, it is allowable to provide either a single function printer which does not include the scanner section 3 and which does not have the scanner function and the copy function, or a machine which further includes a communicating section to possess the facsimile function or the like. When the image-recording apparatus according to the present invention is embodied as a multifunction device, it is allowable to provide either a small type machine as the image-recording apparatus 1 as described in this embodiment, or a large type machine including a plurality of paper feed cassettes and an auto document feeder (ADF). The image-recording apparatus 1 is principally connected to a computer (not illustrated) to record images and documents on the recording paper on the basis of the image data and the document data transmitted from the computer. Additionally, the image data, which is outputted from a digital camera, can be recorded on the recording paper when the image-recording apparatus 1 is connected to the digital camera. Further, the image data or the like, which is recorded in a recording medium, can be recorded on the recording paper when various recording media are charged or loaded into the image-recording apparatus 1.

As shown in FIG. 1, the image-recording apparatus 1 has a substantially rectangular parallelepiped shape. The printer section 2 is disposed at a lower portion of the image-recording apparatus 1. The printer section 2 has an opening 2*a* formed at the front. A paper feed tray 20 and a paper discharge tray 21 are provided at the upper and lower stages so that they are exposed on the opening 2*a*. The paper feed tray 20 stores the recording paper as the recording medium, which is capable of accommodating the recording paper having various sizes including, for example, the A4 size and the smaller sizes, i.e., the B5 size and the postcard size. The tray surface can be expanded by drawing out a slide tray 20*a*, if necessary. The recording paper (not shown), which is accommodated in the paper feed tray 20, is transported into the printer section 2 to record a desired image, and the recording paper is discharged to the paper discharge tray 21.

Figure 2:
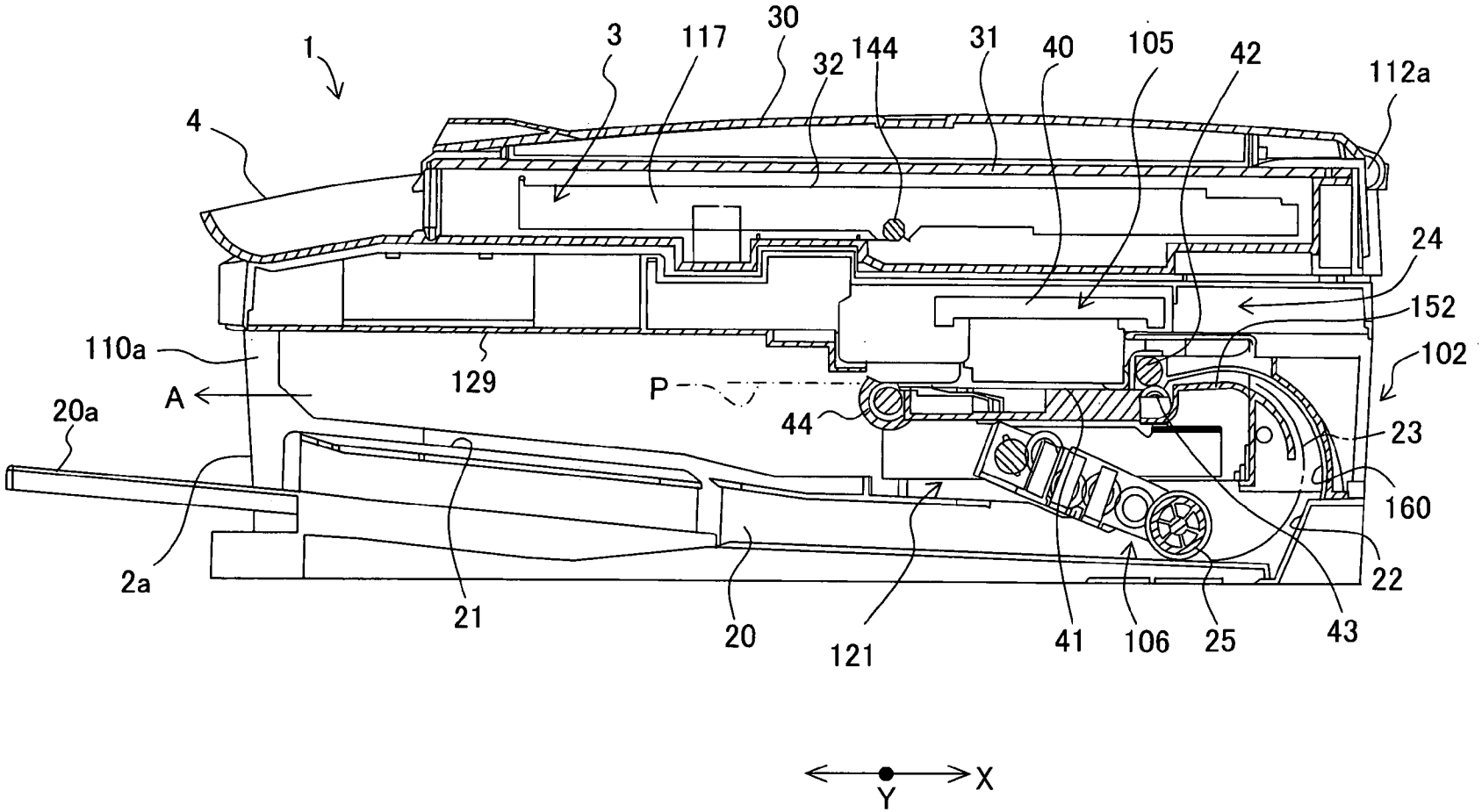
FIG. 2 shows a longitudinal sectional view illustrating an internal structure of the image-recording apparatus 1.

The scanner section 3 is disposed at an upper portion of the image-recording apparatus 1, which is constructed as a so-called flat bed scanner. As shown in FIGS. 1 and 2, a platen glass 31 and an image-reading carriage 32 are provided under an original cover 30 which is provided openably/closably as a top plate of the image-recording apparatus 1. An original, from which the image is read or picked up, is placed on the platen glass 31. The image-reading carriage 32, which has the primary scanning direction of the depth direction of the image-recording apparatus 1, is provided under the platen glass 31 so that the image-reading carriage 32 can be subjected to the scanning in the widthwise direction (Y direction in FIG. 1) of the image-recording apparatus 1.

An operation panel 4 is provided at an upper portion of the front of the image-recording apparatus 1 for operating the printer section 2 and the scanner section 3. The operation panel 4 includes various operation buttons and a liquid crystal display section. The image-recording apparatus 1 is operable by both of the operation instruction inputted from the operation panel 4 and the instruction transmitted via a printer driver from the computer when the image-recording apparatus 1 is connected to the computer. A slot section 5, to which various small type memory cards as recording media can be charged, is provided at an upper-left portion of the front of the image-recording apparatus 1. The input can be performed from the operation panel 4 in order that the image data, which is recorded on the small type memory card charged to the slot section 5, is read to display the data on the liquid crystal display unit, and any arbitrary image is recorded on the recording paper by the printer section 2.

In this embodiment, ink cartridges for the respective colors of black (Bk), cyan (C), magenta (M), and yellow (Y) are accommodated as the cartridges for the individual colors in an ink storage section (not illustrated). The respective ink cartridges are always connected to a recording head (ink-jet recording head) 40 included in a recording section (image-recording section) 24 via flexible ink supply tubes.

The paper feed cassette (paper feed tray) 20, which is insertable from the opening (open section) 2*a* disposed on the front side (left side in FIG. 2), is arranged at the bottom of the housing 102. In this embodiment, the paper feed cassette 20 has such a form that a plurality of sheets of the printing paper P, which are cut to have, for example, the A4 size, the letter size, the legal size, or the postcard size, can be accommodated while being stacked (accumulated) so that the short side of the printing paper P extends in the direction (Y axis direction in FIG. 2) perpendicular to the printing paper transport direction (X axis direction).

Figure 4:
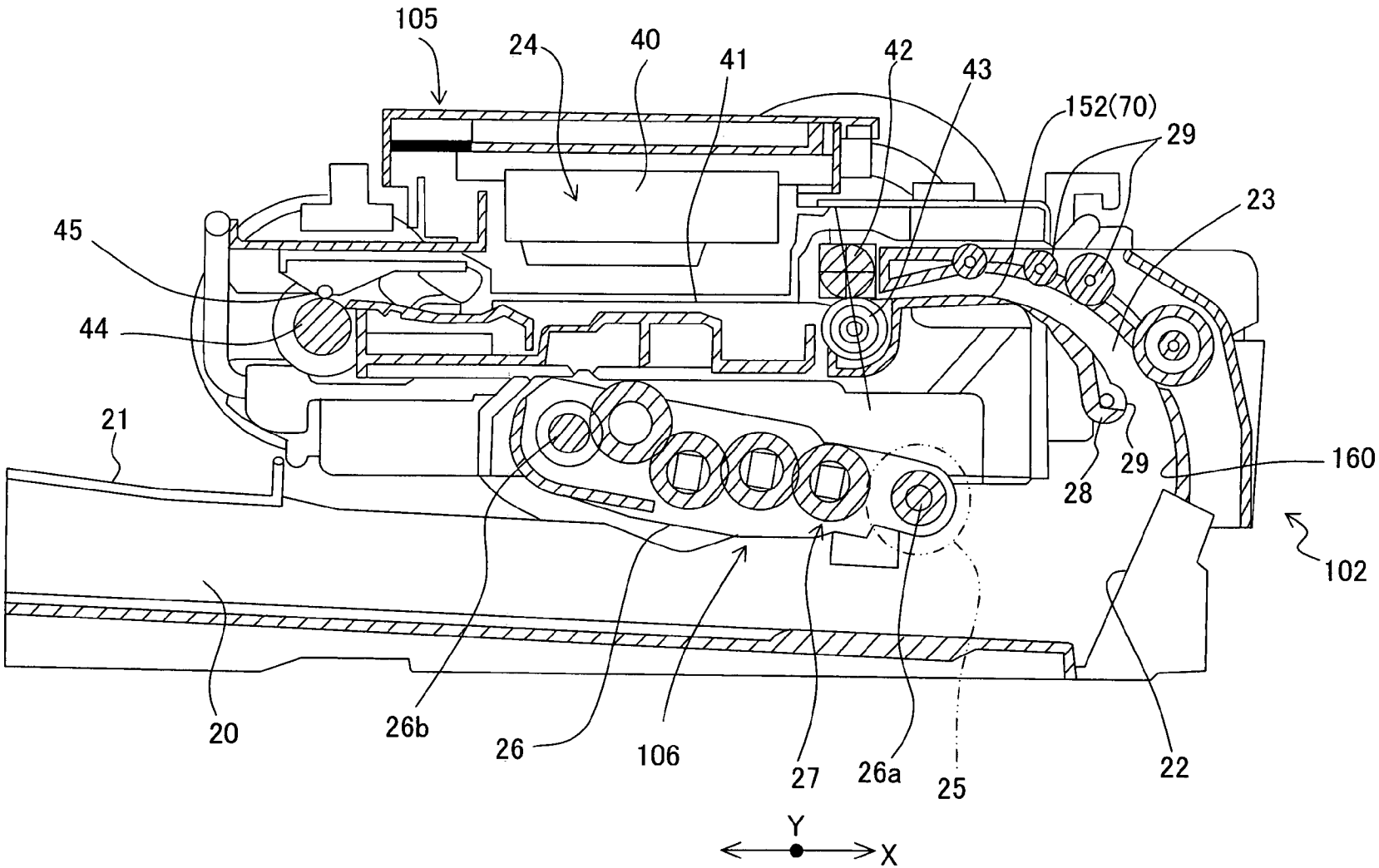
FIG. 4 shows a sectional view taken along a line IV-IV shown in FIG. 3.

An inclined separation plate 22 for separating the printing paper is arranged on the far side (right side in FIG. 2) of the paper feed cassette 20. As shown in FIG. 4, the proximal end of a paper feed arm 26 of a paper feed means (paper feed unit) 106 is installed on the side of the housing 102 so that the paper feed arm 26 is rotatable in the upward and downward directions. The rotation is transmitted from a driving source (not illustrated) via a gear transmission mechanism (driving transmission mechanism) 27 provided in the paper feed arm 26 to a paper feed roller 25 provided at the tip of the paper feed arm 26 (see FIG. 4). The printing paper P as the recording medium stacked (accumulated) in the paper feed cassette 20 is separated and transported one by one by the paper feed roller 25 and the inclined separation plate 22. The separated printing paper P is transported via a transport passage 23 including a laterally directed U-turn pass to the recording section (image-recording section) 24 provided on the upper side (at a high position) behind the paper feed cassette 20.

As shown in FIGS. 2 and 4, those disposed on the upstream side of the platen 41 in the transport direction are a driving roller 42 which serves as a transport (resist) roller for transporting the printing paper P to the position under the lower surface of the recording head 40, and nip rollers 43 which are disposed below the driving roller while being opposed to the driving roller 42. The driving roller 42 and the nip rollers 43 will be described in detail later on. Those disposed on the downstream side of the platen 41 in the transport direction are a paper discharge roller 44 which is driven so that the printing paper P having been subjected to the recording is transported (discharged) to the paper discharge section (paper discharge tray) 21, and spur rollers 45 which are urged toward the paper discharge roller 44 while being opposed thereto.

As shown in FIG. 2, the paper discharge section 21, to which the printing paper P having been subjected to the recording in the recording section 24 is discharged with its recorded surface being directed upwardly, is formed on the upper side of the paper feed cassette 20. A paper discharge port 110*a*, which is communicated with the paper discharge section 21, is open commonly to the opening 2*a* disposed at the front surface of the housing 102. A partition plate (lower cover member) 129, which is made of synthetic resin, is formed integrally with the housing 102 to cover the upper portion of the paper discharge section 21 over a range from the lower surface of a guide member 123 disposed on the downstream side in the transport direction of the printing paper to the paper discharge port 110*a* disposed at the front end of the housing 102.

An explanation will be made below with reference to FIGS. 2 and 4 about the internal structure of the image-recording apparatus 1, especially about the structure of the printer section 2. As shown in the drawings, the inclined separation plate 22, which separates the sheets of the recording paper stacked in the paper feed tray 20 to guide the recording paper upwardly, is arranged on the far side of the paper feed tray 20 provided at the bottom of the image-recording apparatus 1. The transport passage 23 is formed upwardly from the inclined separation plate 22. The transport passage 23 extends in the upward direction, and then the transport passage 23 is bent toward the front surface side to extend from the back surface side to the front surface side of the image-recording apparatus 1. The transport passage 23 passes through the image-recording section 24 to make communication with the paper discharge tray 21. Therefore, the recording paper, which is accommodated in the paper feed tray 20, is guided by the transport passage 23 from the lower portion to the upper portion so that the recording paper makes the U-turn to arrive at the image-recording section 24. After the image is recorded by the image-recording section 24, the recording paper is discharged to the paper discharge tray 21.

As shown in FIG. 4, the paper feed roller 25 is provided over the paper feed tray 20 in order that the recording paper, which is stacked in the paper feed tray 20, is separated one by one to be supplied to the transport passage 23. The paper feed roller 25 is rotatably supported at the tip 26*a* of the paper feed arm 26 which is movable vertically so that the paper feed arm 26 is capable of making contact and separation with respect to the paper feed tray 20. The paper feed roller 25 is rotated in accordance with the transmission of the driving of a motor (not shown) by the aid of the driving force transmission mechanism 27 including a plurality of gears meshed with each other. The paper feed arm 26 is arranged swingably in the vertical direction about the axis of the proximal end 26*b*. In the waiting state, the paper feed arm 26 is lifted upwardly, for example, by a paper feed clutch (not illustrated) or a spring (state shown in FIG. 4). The paper feed arm 26 makes the swinging movement downwardly when the recording paper is supplied. When the paper feed arm 26 makes the swinging movement downwardly, the paper feed roller 25, which is rotatably supported at the tip, makes contact with the surface of the recording paper on the paper feed tray 20 under the pressure. When the paper feed roller 25 is rotated in this state, the recording paper, which is disposed at the uppermost position, is fed to the inclined separation plate 22 by the aid of the frictional force exerted between the recording paper and the roller surface of the paper feed roller 25. The tip of the recording paper abuts against the inclined separation plate 22 to be guided upwardly, and the recording paper is fed into the transport passage 23. When the recording paper, which is disposed at the uppermost position, is fed by the paper feed roller 25, the recording paper, which is disposed just under the recording paper at the uppermost position, is fed together in some cases due to the action of the friction and/or the static electricity. However, the recording paper, which is erroneously fed as described above, abuts against the inclined separation plate 22, and thus the recording paper is stopped thereby.

The transport passage 23 is comparted between an outer guide surface 160 (first transport wall) and an inner guide surface 152 (second transport wall) which are opposed to one another with a predetermined spacing distance intervening therebetween, at portions other than those arranged, for example, with the image-recording section 24. For example, the transport passage 23 is constructed on the back surface side of the image-recording apparatus 1 such that the outer guide surface 160 is formed integrally with the frame of the image-recording apparatus 1, and the inner guide surface 152 is constructed by fixing the guide member 28 in the frame. Various types of transport rollers 29 are provided rotatably in the axial direction of the widthwise direction of the transport passage 23 in the transport passage 23, especially at portions at which the transport passage 23 is bent so that the roller surfaces are exposed to the outer guide surface 160 or the inner guide surface 152. The respective transport rollers 29 provide the smooth transport of the recording paper which make contact with the guide surfaces.

As shown in FIG. 4, the image-recording section 24 is provided on the downstream side after the transport passage 23 makes the U-turn from the lower position to the upper position. The image-recording section 24 is provided with the ink-jet recording head 40 carried on a scanning carriage (not illustrated). The ink-jet recording head 40 is subjected to the scanning while discharging the inks of the respective colors of cyan (C), magenta (M), yellow (Y), and black (K) supplied from the ink cartridges (not illustrated), and thus the image is recorded on the recording paper transported on the platen 41. The recording head 40 can be subjected to the scanning in the primary scanning direction (Y direction) and the secondary scanning direction (X direction).

The recording section 24 is provided between first and second guide members 122, 123 which are supported by a box-shaped main frame 121 and a pair of left and right side plates 121*a* and which are laterally long plate-shaped to extend in the Y axis direction (primary scanning direction). The carriage 105, on which the ink-jet type recording head 40 of the recording section 24 is carried, is supported (carried) slidably over the first guide member 122 on the upstream side and the second guide member 123 on the downstream side in the transport direction of the printing paper so that the carriage 105 can make the reciprocating movement.

In order to effect the reciprocating movement of the carriage 105, a timing belt 124, which extends in the primary scanning direction (Y axis direction), is arranged over the upper surface of the second guide member 123 arranged on the downstream side in the transport direction of the printing paper (direction of the arrow A). A CR (carriage) motor (not shown), which drives the timing belt 124, is fixed to the lower surface of the second guide member 123.

Figure 3:
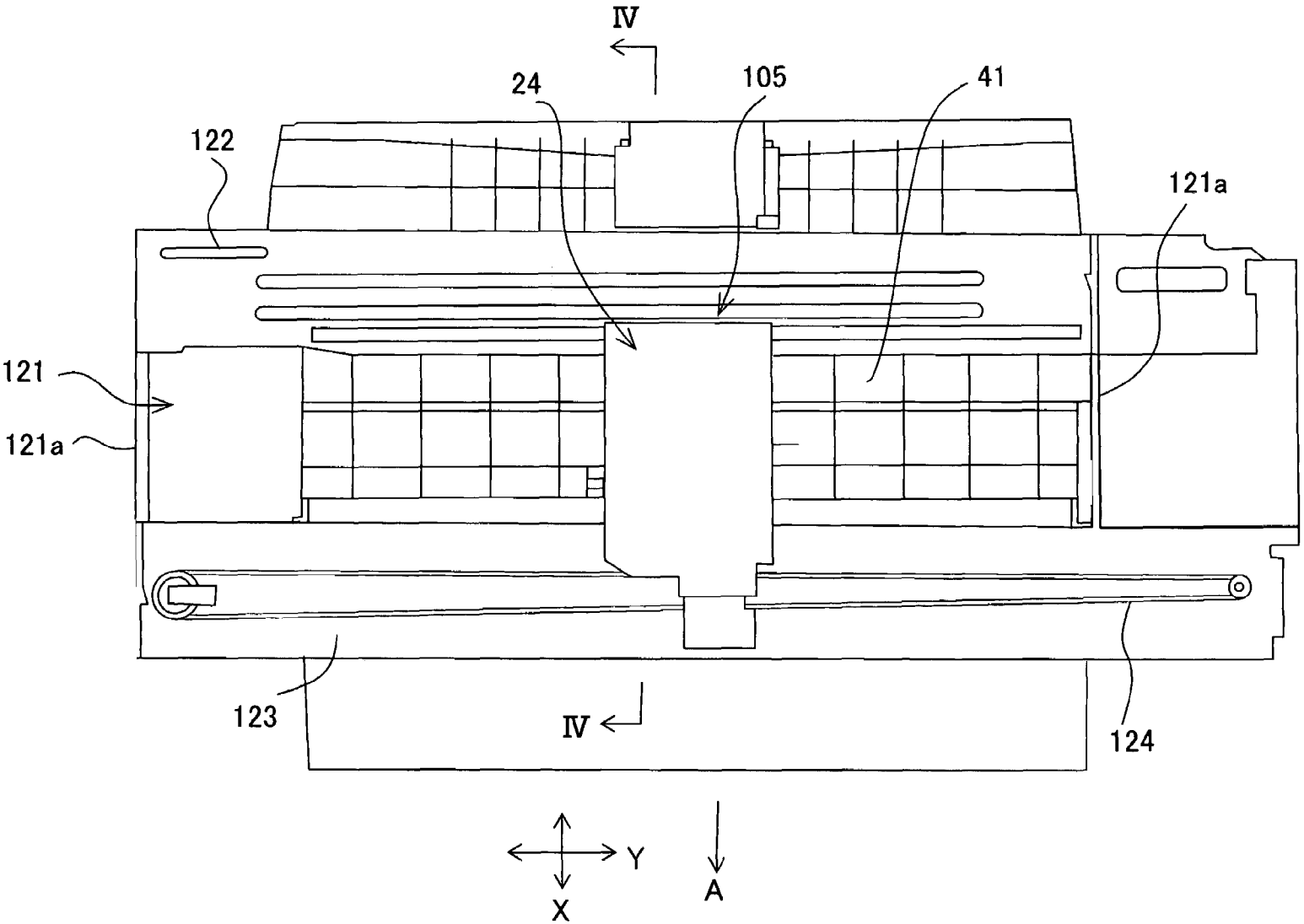
FIG. 3 shows a plan view illustrating the image-recording apparatus in a state in which an image-reading unit is removed.

As shown in FIGS. 3 and 4, the flat platen 41, which extends in the Y axis direction to oppose to the lower surface of the recording head 40 of the carriage 105, is fixed to the main frame 121 between the both guide members 122, 123.

As shown in FIG. 4, the driving roller 42 and the nip rollers (holding rollers for interposing the recording paper between the driving roller and these rollers) 43, which transport the recording paper onto the platen 41 while interposing the recording paper transported on the transport passage 23, are provided on the upstream side of the image-recording section 24. On the other hand, the paper discharge roller 44 and the spur rollers 45, which interpose and transport the recording paper having been already subjected to the recording, are provided on the downstream side of the image-recording section 24. The driving force is transmitted from a motor (not illustrated) to the driving roller 42 and the paper discharge roller 44, and each of them is driven intermittently by a predetermined line feed amount. On the other hand, the nip rollers 43 are provided rotatably while being urged to make contact with the driving roller 42 under the pressure. When the recording paper enters the space between the nip rollers 43 and the driving roller 42, the nip rollers 43 are retracted by an amount corresponding to the thickness of the recording paper to interpose the recording paper together with the driving roller 42 so that the rotational force of the driving roller 42 is reliably transmitted to the recording paper. The spur rollers 45 are provided similarly with respect to the paper discharge roller 44. However, spur-shaped concave/convex portions are formed on the roller surfaces so that the image recorded on the recording paper is not deteriorated, because the spur rollers 45 make contact with the recording paper after the recording under the pressure.

Therefore, the recording paper, which is interposed by the driving roller 42 and the nip rollers 43, is intermittently transported on the platen 41 by the predetermined line feed amount. Every time when the line feed operation is performed, the ink-jet recording head 40 is subjected to the scanning to record the image from the forward end side of the recording paper. The forward end of the recording paper on which the image has been recorded is thereafter interposed by the paper discharge roller 44 and the spur rollers 45. The recording paper is intermittently transported by the predetermined line feed amount in a state in which the forward end side of the recording paper is interposed by the paper discharge roller 44 and the spur rollers 45 and the rearward end side of the recording paper is interposed by the driving roller 42 and the nip rollers 43. The image is recorded by the ink-jet recording head 40 in the same manner as described above. When the recording paper is further transported, then the rearward end of the recording paper passes through the driving roller 42 and the nip rollers 43, and the rearward end of the recording paper is released from the state of being interposed by them. The recording paper is intermittently transported by the predetermined line feed amount by the paper discharge roller 44 and the spur rollers 45. The image is recorded by the ink-jet recording head 40 in the same manner as described above. After the image is recorded in a predetermined area of the recording paper, the paper discharge roller 44 is continuously driven and rotated. The recording paper, which is interposed by the paper discharge roller 44 and the spur rollers 45, is discharged to the paper discharge tray 21.

Figure 5:
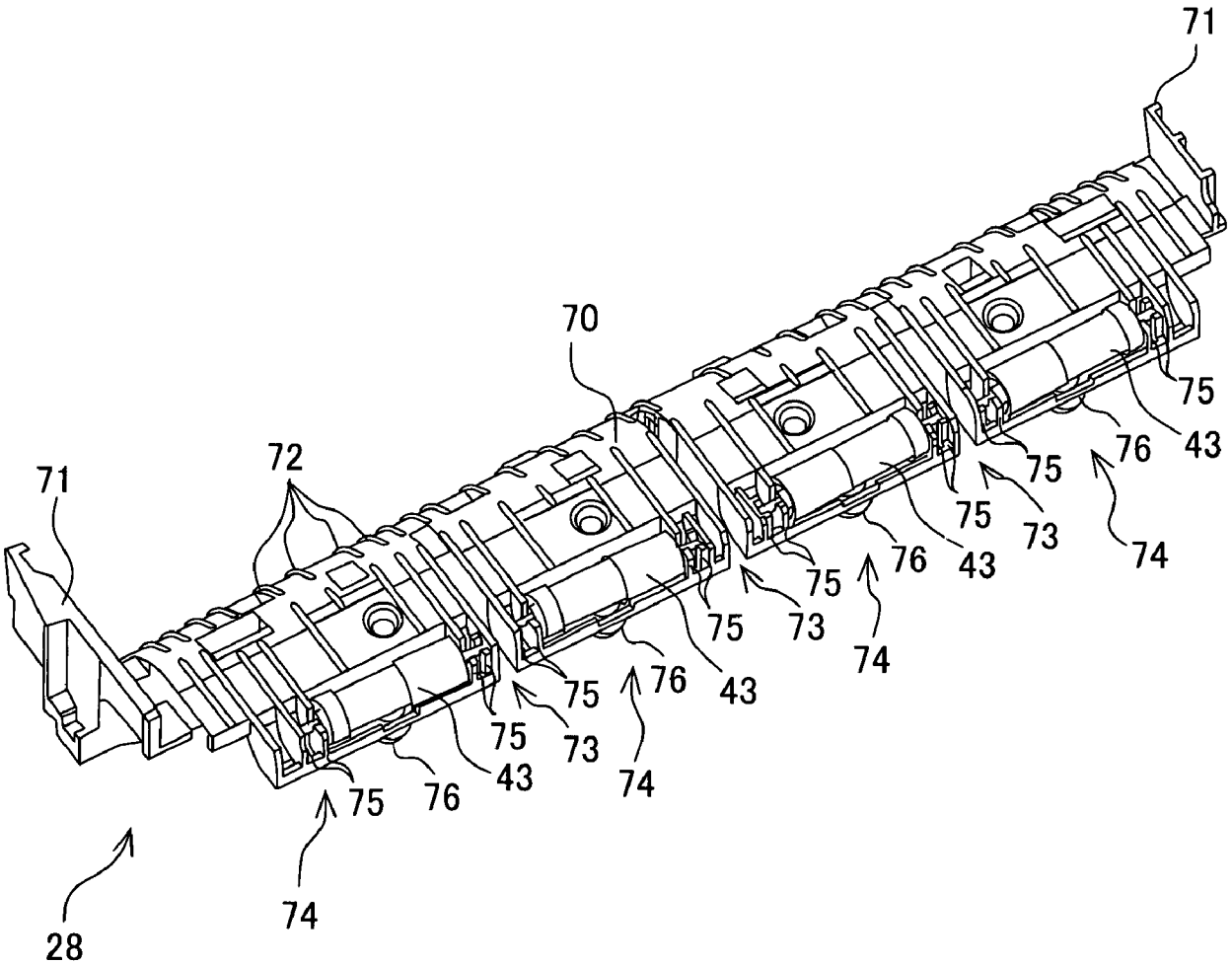
FIG. 5 shows a perspective view illustrating the structure of a guide member 28.

The driving roller 42 and the nip rollers 43 will be explained in detail with reference to FIG. 5. FIG. 5 shows the guide member 28 described above. The respective nip rollers 43 are rotatably supported by the guide member 28 respectively. The guide member 28 forms a guide surface 70 which serves as the inner guide surface 152 of the transport passage 23. The guide member 28 is fixed to the frame or the like of the image-recording apparatus 1 by the aid of attachment sections 71 formed on the both ends. A portion of the guide surface 70, which is disposed on the upstream side, is formed to be a curved surface which is curved from the lower side to the upper side. Another portion of the guide surface 70, which is disposed on the downstream side, is formed to have a substantially plane shape. Guide ribs 72 are appropriately formed in the transport direction on the guide surface 70. Accordingly, the contact area, which is to be formed between the recording paper and the guide surface 70, is decreased in order to mitigate the friction.

Cutouts 73 are formed at predetermined intervals for the guide member 28 at the downstream end of the guide surface 70 in the transport direction. Accordingly, the downstream end portion is divided into four. Nip roller support sections (holding roller support sections) 74 are formed for the respective divided portions. The nip roller support sections 74 are recessed so that they are slightly wider than the length of the nip roller 43 in the axial direction. Support tabs 75 for rotatably supporting the nip rollers 43 are provided upstandingly on the both end sides thereof. The support tabs 75 are formed with bearings for supporting the rotary shafts of the nip rollers 43. Each of the nip rollers 43 is rotatably supported by the both support tabs 75, which is arranged so that a part of the roller surface protrudes from the guide surface 70. The roller surfaces make contact with the recording paper to be transported while being guided by the guide surface 70. The height, at which each of the nip rollers 43 protrudes from the guide surface 70, may be appropriately established. However, it is preferable that the height is approximately the same as the height of the guide rib 72. A spring receiver 76 is formed at the bottom surface of each of the nip roller support sections 74. A coil spring 158 (see FIG. 9) is allowed to intervene between each of the spring receivers 76 and the frame or the like of the image-recording apparatus 1. Accordingly, the respective nip roller support sections 74 are urged upwardly. The guide member 28 is formed of a material such as synthetic resin capable of elastic deformation. Each of the nip roller support sections 74 is capable of elastic deformation in the vertical direction with ease owing to the cutout 73. Therefore, the respective nip rollers 43 are urged toward the unillustrated driving roller 42 which is arranged thereover. Further, the respective nip rollers 43 can be retracted downwardly depending on the thickness of the recording paper to be interposed between the respective nip rollers 43 and the driving roller 42. The four nip rollers 43 are provided in array in the axial direction of the driving roller 42 as described above.

Figure 6:
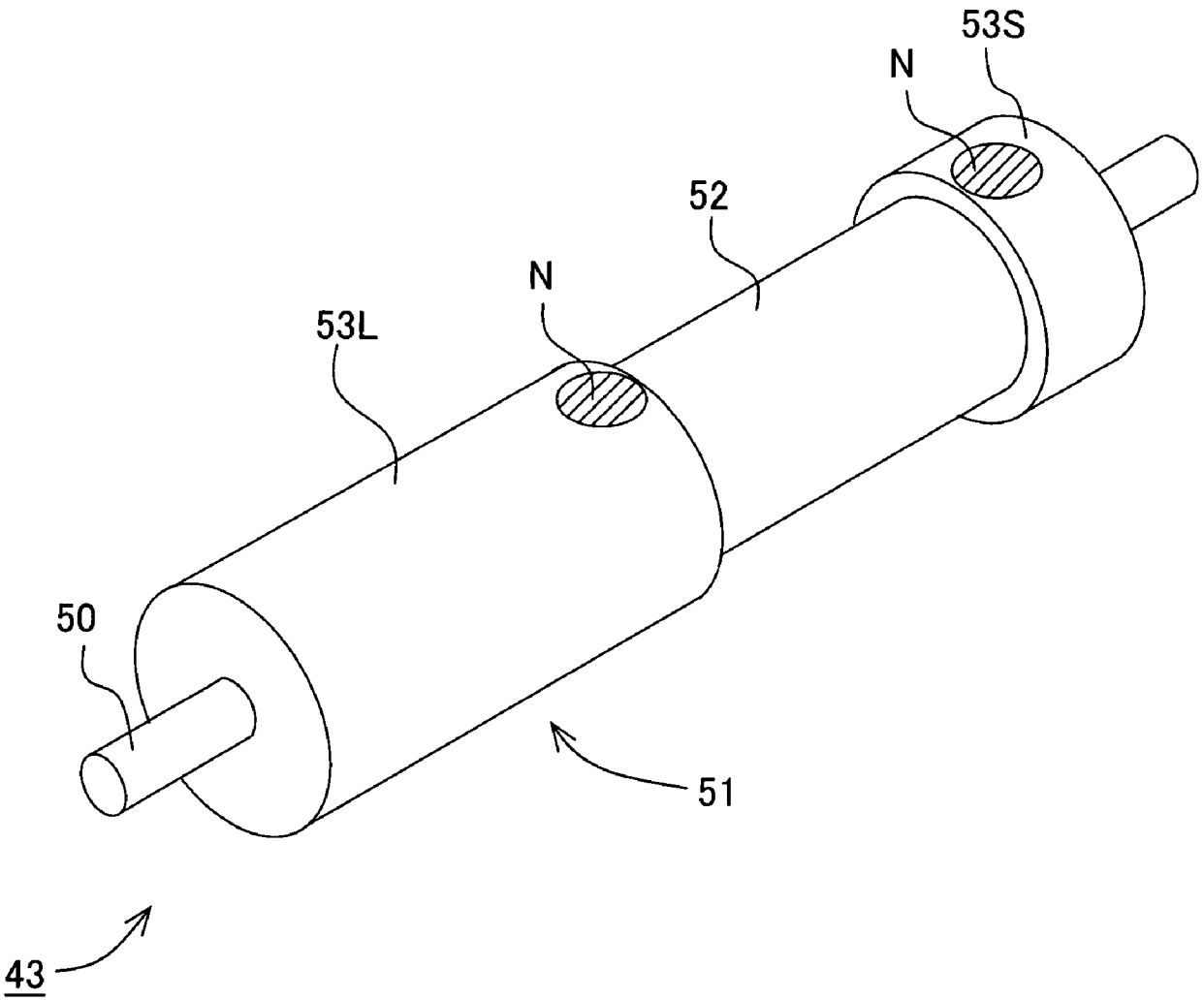
FIG. 6 shows a perspective view illustrating the structure of a nip roller 43.

FIG. 6 shows the structure of the nip roller 43. As shown in the drawing, the nip roller 43 includes a roller 51 made of resin which is rotatably attached to a shaft (rod) 50 made of metal. The nip roller 51 may be rotatably supported by the shaft 50 by a method as described in a third embodiment described later on. Rigid plastic, which undergoes less deformation, is preferably usable as the material for the roller 51. Alternatively, the roller 51 may be rotatably supported by a coil spring in place of the shaft 50 made of metal. A recessed cutout 52, which is depressed in the radial direction, is formed on the roller 51 while allowing predetermined areas to remain at both ends of the roller 51. That is, the both sides (53L, 53S) of the roller 51 in the axial direction have the diameter larger than that of the central portion (52) disposed therebetween. The respective predetermined areas, which remain on the both sides of the recessed cutout 52, serve as nip sections 53L, 53S to make contact with the driving roller 42 under the pressure. The respective nip rollers 43 are arranged such that the shafts 50 thereof are inclined by predetermined angles in the transport direction with respect to the shaft of the driving roller 42 as described later on. When the shafts 50 are inclined, the nips at the nip positions, which are formed by the contact between the nip rollers 43 and the driving roller 42, reside in a dot-shaped form but not in a line-shaped form. When the recessed cutout 52 is formed at the position corresponding to the presence of the dot-shaped nip positions, the nip roller 43 makes contact with the driving roller 42 under the pressure at the two positions of the nip sections 53L, 53S disposed on the both sides of the recessed cutout 52. The areas are shown in the drawing as the nip areas (nip positions) N. The respective nip sections 53L, 53S are formed to have an identical diameter. Therefore, the portions, which are disposed just on the both sides of the recessed cutout 52, are the nip positions N of the nip sections 53L, 53S. Therefore, the distance between the nip positions N differs depending on the width of the recessed cutout 52. The spacing distance between the two nip positions N in the transport direction is established by the distance and the angle of inclination of the nip roller 43. The recessed cutout 52 is designed so that the spacing distance is the unit transport distance by which the recording paper is transported as the driving roller 42 is driven intermittently.

In this embodiment, the width of the nip section 53L is different from the width of the nip section 53S in the axial direction. The width of the nip section 53L is wider than the width of the nip section 53S. However, the widths of the respective nip sections 53L, 53S are set while considering, for example, the transport angle of the recording paper to be transported to the platen 41 by being interposed by the driving roller 42 and the nip rollers 41. The widths are not specifically limited. In particular, as shown in FIG. 4, the nip rollers 43 are positioned on the upstream side in the transport direction as compared with the driving roller 42. That is, the nip rollers 43 make contact with the driving roller 42 at a position lower than the maximum height position of the nip rollers 43. Therefore, the recording paper, which is transported by being interposed by the driving roller 42 and the nip rollers 43, is fed while being directed downwardly by a predetermined angle as compared with the horizontal plane. Accordingly, the recording paper is transported as if it is pushed or pressed against the platen 41. The distance between the ink-jet recording head 40 and the recording paper is maintained to be constant. Considering the angle at which the recording paper is fed as described above, the position, at which the nip position N is located on the roller 51, is established together with the angle of inclination of the nip roller 43 and the positional relationship between the driving roller 42 and the nip roller 43. The widths of the nip sections 53L, 53S are established in relation thereto as well.

Figure 7:
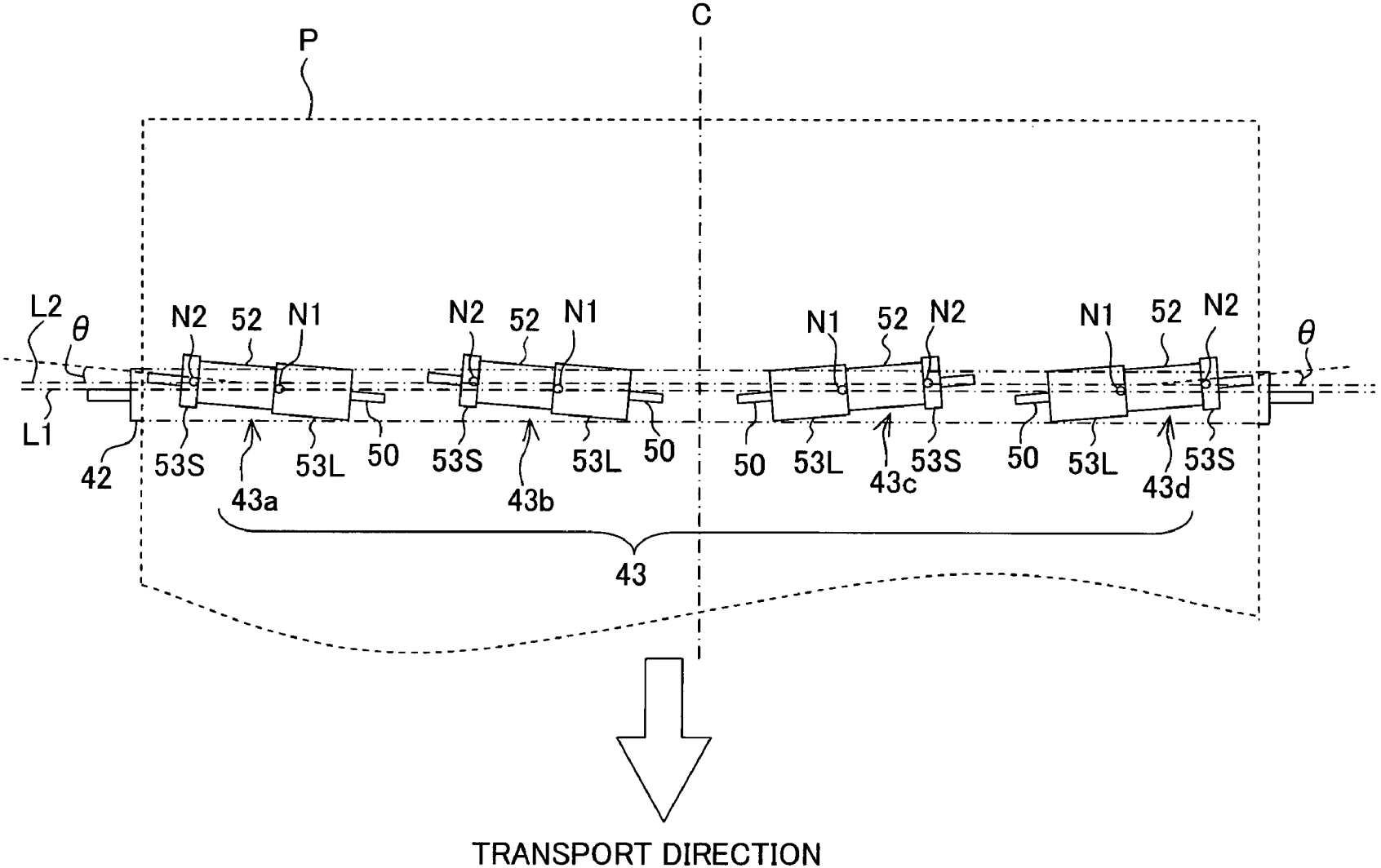
FIG. 7 shows a plan view illustrating the positional relationship between a driving roller 42 and the respective nip rollers 43.

FIG. 7 shows the arrangement of the respective nip rollers 43 with respect to the driving roller 42. As shown in the drawing, the four nip rollers 43 (43*a* to 43*d*) are provided in a form of array in the axial direction of one driving roller 42. The driving roller 42 has a certain width in the axial direction of the roller, i.e., at least an entire paper feed width corresponding to the recording paper of a plurality of sizes to be transported including, for example, the A4 size and the postcard size. It is preferable for the roller that the ceramic coating is applied to the surface of the roller made of metal to give the frictional force with respect to the recording paper, because of the strong resistance against the temperature change and the high transport performance for the recording paper. In the case of the printer section 2 of this embodiment, the transport is effected while allowing the center C of the transport passage 23 in the widthwise direction (one-dot chain line shown in FIG. 7) to coincide with the center of the recording paper. Therefore, the respective nip rollers 43 are disposed left-right symmetrically in the widthwise direction corresponding to the recording paper of a plurality of sizes to be transported including, for example, the A4 size and the postcard size, and the respective nip rollers 43 are arranged in the vicinity of the both ends of the recording paper of the respective sizes. For example, the two nip rollers 43*a*, 43*d*, which are disposed on the both end sides as shown in FIG. 7, correspond to those disposed in the vicinity of the both ends of the A4 size. The two nip rollers 43*b*, 43*c*, which are disposed centrally, correspond to the postcard size. When the nip rollers 43 are arranged in the vicinity of the both ends of the recording paper, it is possible to interpose and transport the recording paper of various sizes in a well-balanced manner. The recording paper can be interposed and transported in a well-balanced manner as well by arranging the respective nip rollers 43 left-right symmetrically with respect to the center C. In particular, when the recording paper, which is of the size other than the standardized size or the regular size such as the A4 size and the postcard size, is transported, the nip positions are also positioned left-right symmetrically with respect to the recording paper. Therefore, this arrangement is preferred.

The shaft 50 of each of the nip rollers 43 is inclined by a predetermined angle θ with respect to the shaft of the driving roller. As shown in the drawing, the respective four nip rollers 43*a* to 43*d* have the respective shafts 50 which are arranged and inclined by the predetermined angle θ so that the end disposed on the side of the center C in the widthwise direction of the transport passage 23 is on the downstream side in the transport direction. That is, the shafts of the two nip rollers 43*c*, 43*d*, which are disposed on the right side in the drawing, are inclined by the angle θ upwardly slanting to the right, and the shafts of the two nip rollers 43*a*, 43*b*, which are disposed on the left side in the drawing, are inclined by the angle θ upwardly slanting to the left. The shafts 50 of the two nip rollers 43 disposed on the right side in the drawing and the shafts 50 of the two nip rollers 43 disposed on the left side in the drawing are left-right symmetrical with respect to the center C in relation to the angle of inclination. However, the angle θ, by which they are inclined respectively, are identical. Therefore, as shown in the drawing, the recording paper P, which is interposed and transported by the driving roller 42 and the nip rollers 43, is transported while the tensile force to expand outwardly in the widthwise direction is applied by the driving roller 42 and the respective nip rollers 43. Accordingly, it is possible to avoid the occurrence of, for example, the bending and the wrinkles on the recording paper P during the transport.

As shown in FIG. 7, the respective nip rollers 43 are arranged so that the wide width nip sections 53L are disposed on the downstream side in the transport direction. It is now assumed that the nip positions brought about by the respective nip sections 53L are represented by N1, and the nip positions brought about by the respective nip sections 53S are represented by N2. On this assumption, the respective nip positions N1, which constitute the nip position group disposed on the downstream side in the transport direction, are positioned on the straight line L1 extending in the direction perpendicular to the transport direction, and the respective nip positions N2, which constitute the nip position group disposed on the upstream side in the transport direction, are positioned on the straight line L2 extending in the direction perpendicular to the transport direction. When the respective nip positions N1, N2 are located on the straight lines L1, L2 respectively, the timings, at which the driving roller 42 and the respective nip rollers 43 interpose the recording paper P, are simultaneous in the widthwise direction of the recording paper P. This arrangement is especially useful when the inclined transport or the oblique transport is corrected along the nip positions N1 by allowing the forward end of the recording paper P to abut against the driving roller 42 and the respective nip rollers 43 at the nip positions N1 or on the roller surfaces in the stopped state. Further, the timings are also simultaneously obtained thereafter when the driving roller 42 and the respective nip rollers 43 interpose the forward end of the recording paper P. It is advantageous that the recording medium P is transported without causing any inclined transport. As described above, the respective nip sections 53L, 53S of the respective nip rollers 43 are formed to have the same diameter. Therefore, in order that the respective nip positions N1, N2 are located on the straight lines L1, L2 respectively, it is enough that the angles of inclination θ of the respective nip rollers 43 are identical. Therefore, the positional adjustment as described above is easily achieved. Further, as shown in FIG. 6, the respective nip sections 53L, 53S are formed integrally on one roller 51 by forming the recessed cutout 52 on the roller 51 of each of the nip rollers 43. Therefore, the nip sections 53L, 53S are not moved in the axial direction when the recording paper P is transported. That is, the nip positions N1, N2 are not moved in the axial direction. Therefore, the nip positions N1, N2, which are based on the positional adjustment as described above, are also maintained when the recording paper P is transported.

Figure 8:
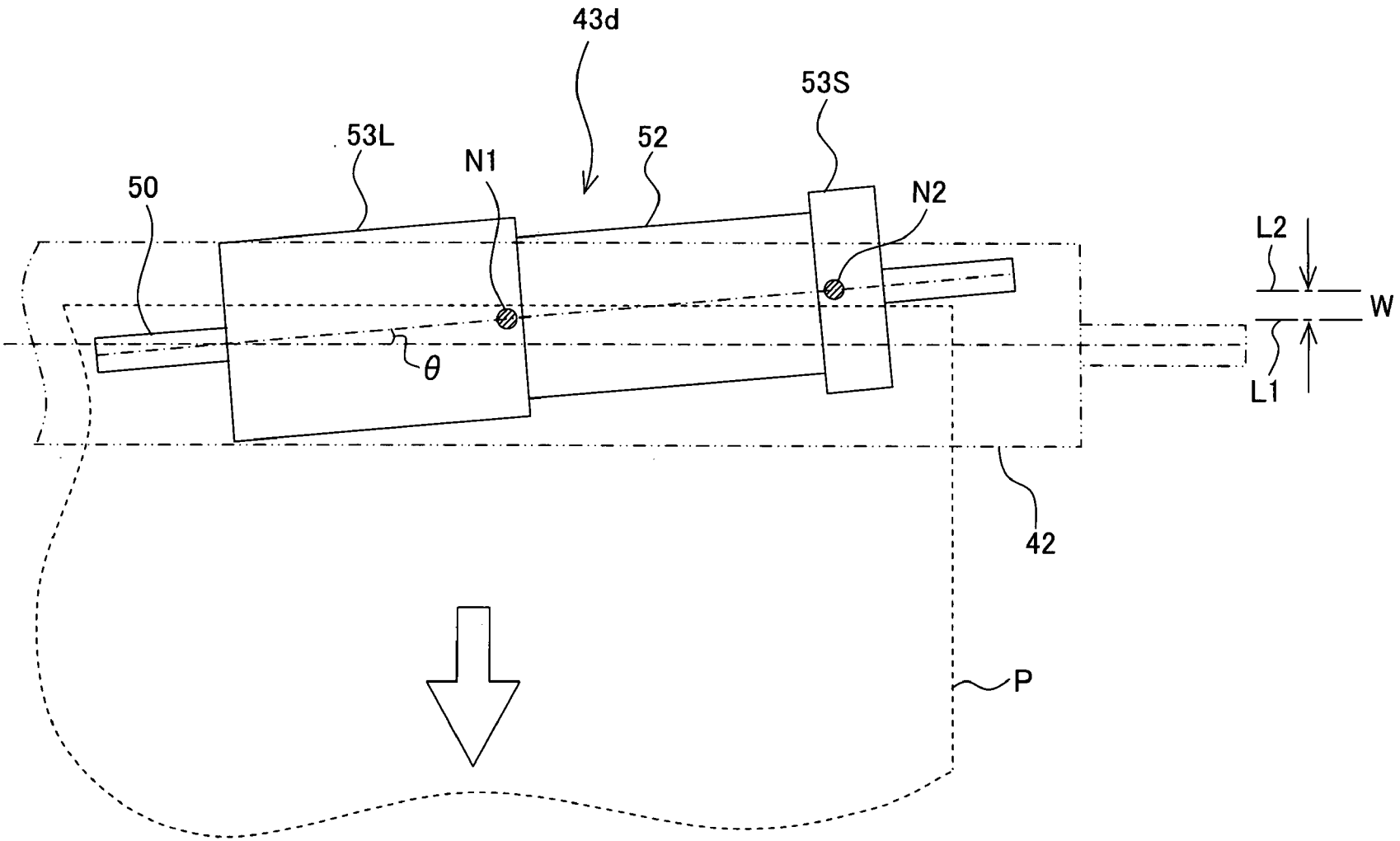
FIG. 8 shows a magnified plan view illustrating the nip roller 43 disposed in the vicinity of the end of the driving roller 42.

FIG. 8 shows a state in which the rearward end of the recording paper P passes over the nip positions N1, N2 as exemplified by the nip roller 43*d* disposed at the right end as shown in FIG. 7 by way of example. As described above, the recessed cutout 52 is formed on the nip roller 43, and the shaft 50 of the nip roller 43 is inclined by the predetermined angle θ with respect to the shaft of the driving roller 42. Accordingly, the respective nip positions N1, N2, at which the nip sections 53L, 53S disposed on the both sides of the recessed cutout 52 make contact with the driving roller 42 under the pressure, are separated from each other by the distance W between the respective positions L1 and L2 in the transport direction as shown in the drawing. The recording paper P is interposed by the driving roller 42 and the respective nip rollers 43 in a divided manner at the nip positions N1, N2, and the nip pressure is dispersed. Further, when the rearward end of the recording paper P passes over the nip positions N1, N2, the recording paper P is released from the interposed state in a divided manner at the nip positions N1, N2. Therefore, the force, which is exerted to push out the recording paper P in the transport direction in accordance with the action of the urging force of each of the nip rollers 43 on the recording paper P when the release operation is effected for each of them, is smaller than that exerted when the angle θ is not provided.

The distance W in the transport direction between the nip positions N1 and N2 is not less than the unit transport distance of the driving roller 42 which is driven intermittently. Accordingly, as shown in the drawing, when the rearward end of the recording paper P passes over the nip positions N1, N2, the operation of the driving roller 42 is necessarily effected intermittently when the rearward end of the recording paper P is positioned between the respective nip positions N1 and N2. It is possible to reliably separate or divide the timings at which the interposed state is released at the respective nip positions N1, N2. Therefore, the pushing or extruding force, which is obtained when the interposed state is released at the nip position N1, is suppressed by the interposed state of the recording paper P at the nip position N2. As described above, the respective nip sections 53L, 53S are integrally formed on one roller 51, and thus the nip positions N1, N2 are not moved in the axial direction. Therefore, the distance W is always maintained as well.

In this arrangement, it is unnecessary that the unit transport distance of the driving roller 42 to be driven intermittently is coincident with the line feed amount provided when the image is recorded on the recording paper P by the image-recording section 24. The line feed amount is varied depending on, for example, the image recording density. In general, the line feed amount is smaller when the image is recorded in accordance with the high quality fine mode than when the image is recorded in accordance with the normal mode. That is, the distance W is established to be constant for the printer section 2 of the image-recording apparatus 1, while the line feed amount is varied depending on the quality of the image to be recorded. For example, when the intermittent driving of the driving roller 42 is divided more finely in order to transport the recording paper P by a minute transport distance while dividing the line feed amount into a plurality of amounts when the rearward end of the recording paper P passes over the nip position N1, N2, the divided minute transport distance is regarded as the unit transport distance. When the intermittent driving of the driving motor 41 is controlled so that the transport distance, which is obtained when the rearward end of the recording paper P passes over the nip position N1, N2, is the minute transport distance irrelevant to the line feed amount which is varied depending on, for example, the image recording density as described above, the constant relationship is obtained between the distance W and the unit transport distance.

As described above, according to the printer section 2 of the image-recording apparatus 1 of this embodiment, it is possible to suppress the overfeed when the rearward end of the recording paper P is released from the interposed state. Further, it is possible to avoid the disturbance of the recorded image which would be otherwise caused in the vicinity of the rearward end. In particular, as in the printer section 2 of the image-recording apparatus 1 of this embodiment, when the transport passage 23, which is disposed on the upstream side from the driving roller 42 and the nip rollers 43, is the so-called U-turn pass in which the recording paper P is guided to the nip positions N1, N2 while effecting the U-turn from the position below the nip positions N1, N2, the recording paper P is transported while being lifted upwardly by the driving roller 42 and the nip rollers 43. Therefore, it is necessary to increase the interposing force at the nip positions N1, N2. In such a situation, the pushing force, which is exerted when the interposed state is released, tends to be strengthened as well. Therefore, the effect as described above is remarkably obtained.

Figure 20:
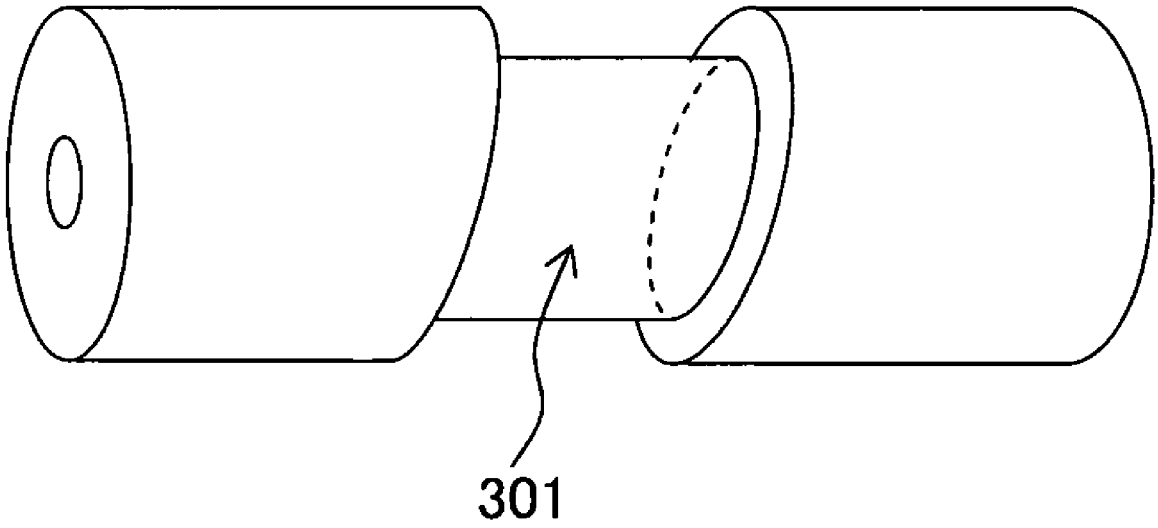
FIG. 20 schematically illustrates a nip roller having a groove formed obliquely with respect to the shaft of the roller.
Figure 21:
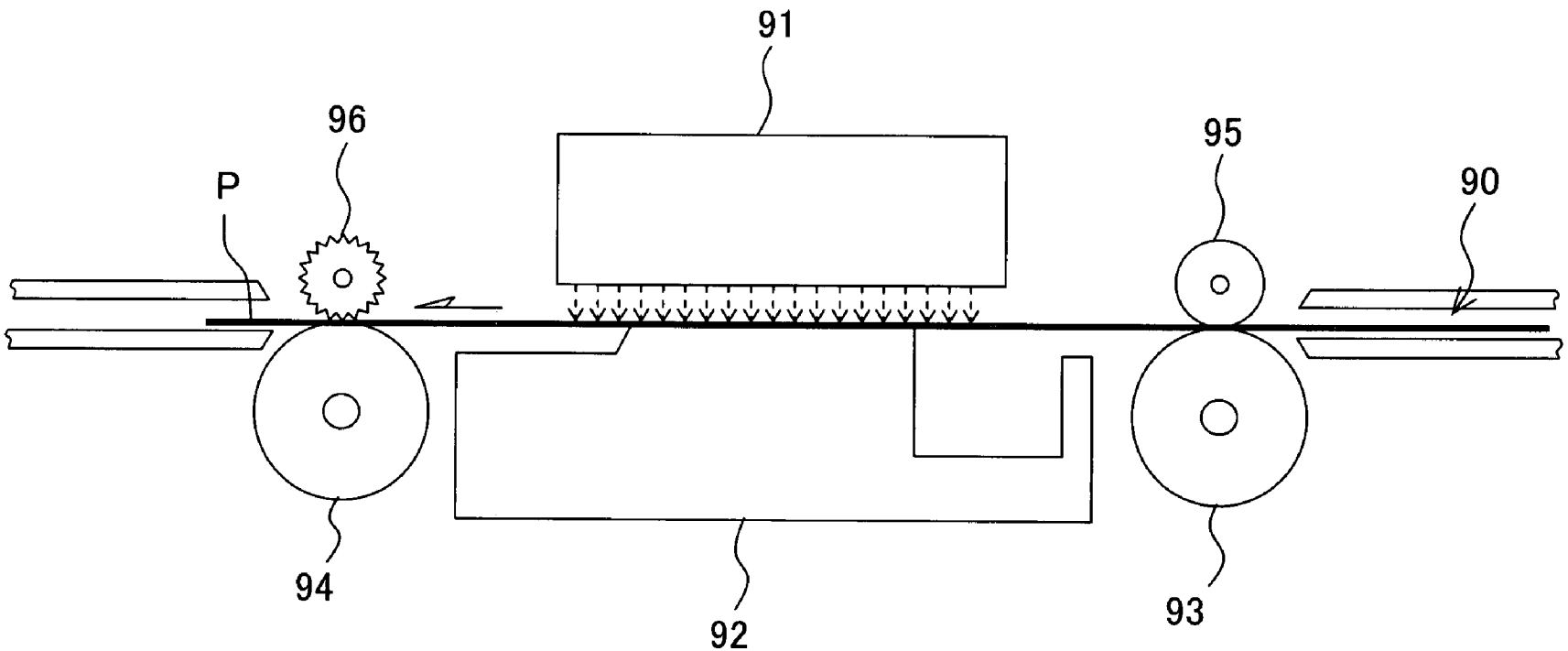
Fig. 21 RELATED ART
FIG. 21 shows the arrangement around an image-recording section of a conventional image-recording apparatus.
Figure 22:
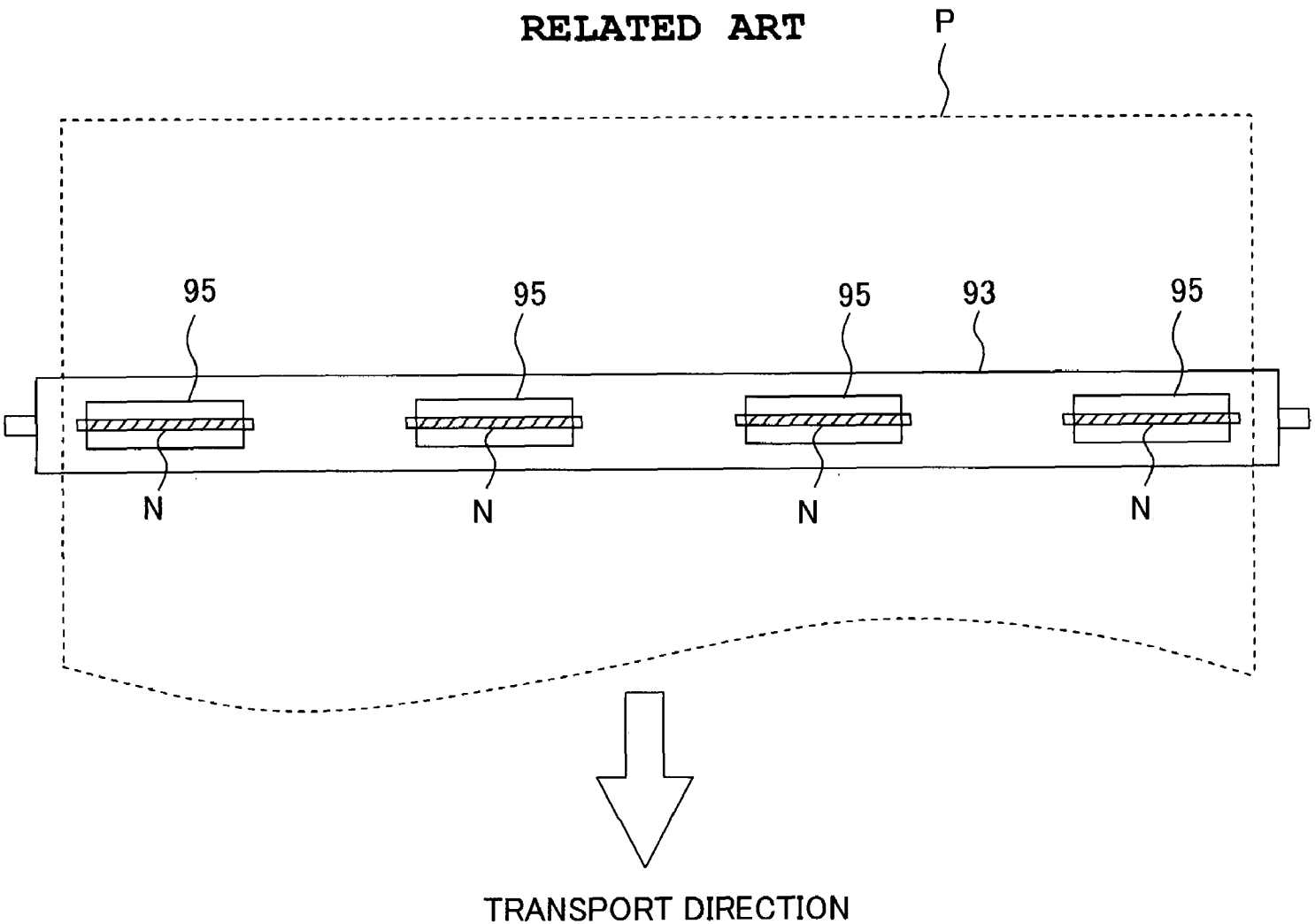
Fig. 22 RELATED ART
FIG. 22 shows a plan view illustrating a driving roller 93 and nip rollers 95 of the conventional image-recording apparatus.
Figure 23A:
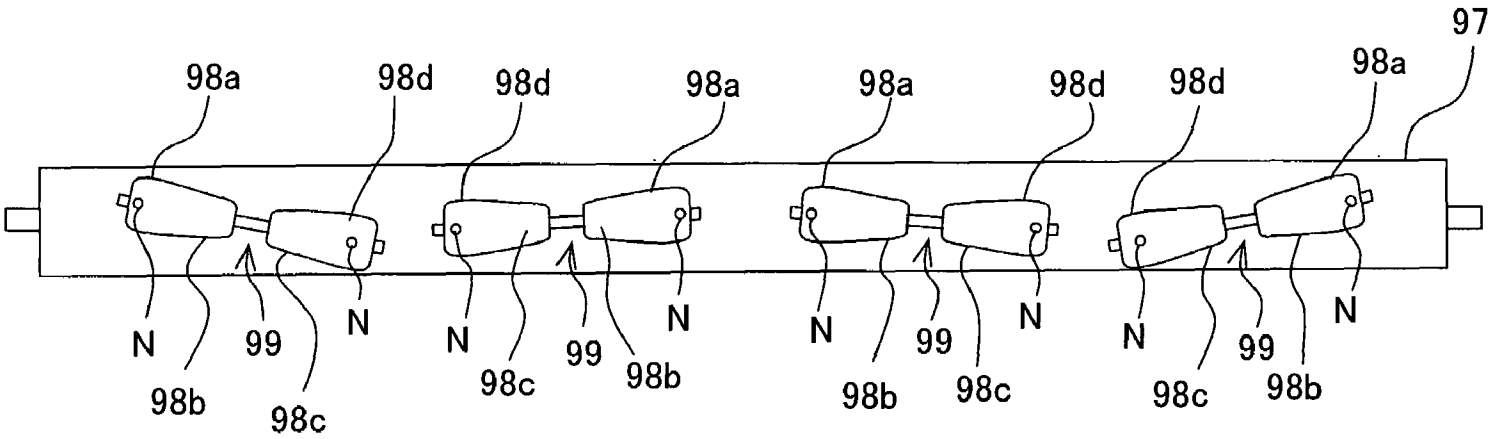
Fig. 23A RELATED ART
FIG. 23A shows a plan view illustrating the arrangement of the driving roller and the nip rollers of the image-recording apparatus described in Japanese Patent Application Laid-open No. 2002-226077.
Figure 23B:
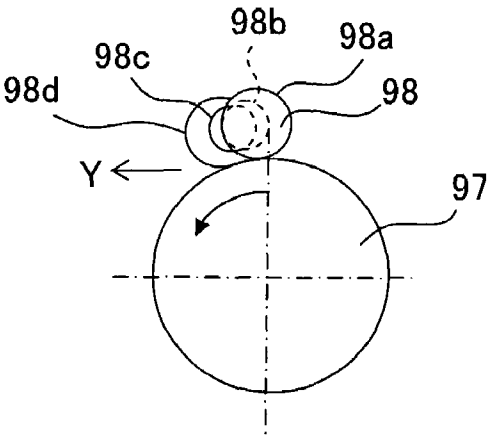
Fig. 23B RELATED ART
FIG. 23B shows a sectional view illustrating the driving roller and the nip roller.

In the first embodiment, the recessed cutout of the nip roller is formed cylindrically in the axial direction. However, as shown in FIG. 20, a recessed cutout 301*a* may be formed obliquely with respect to the axial direction.

Second Embodiment

Figure 9:
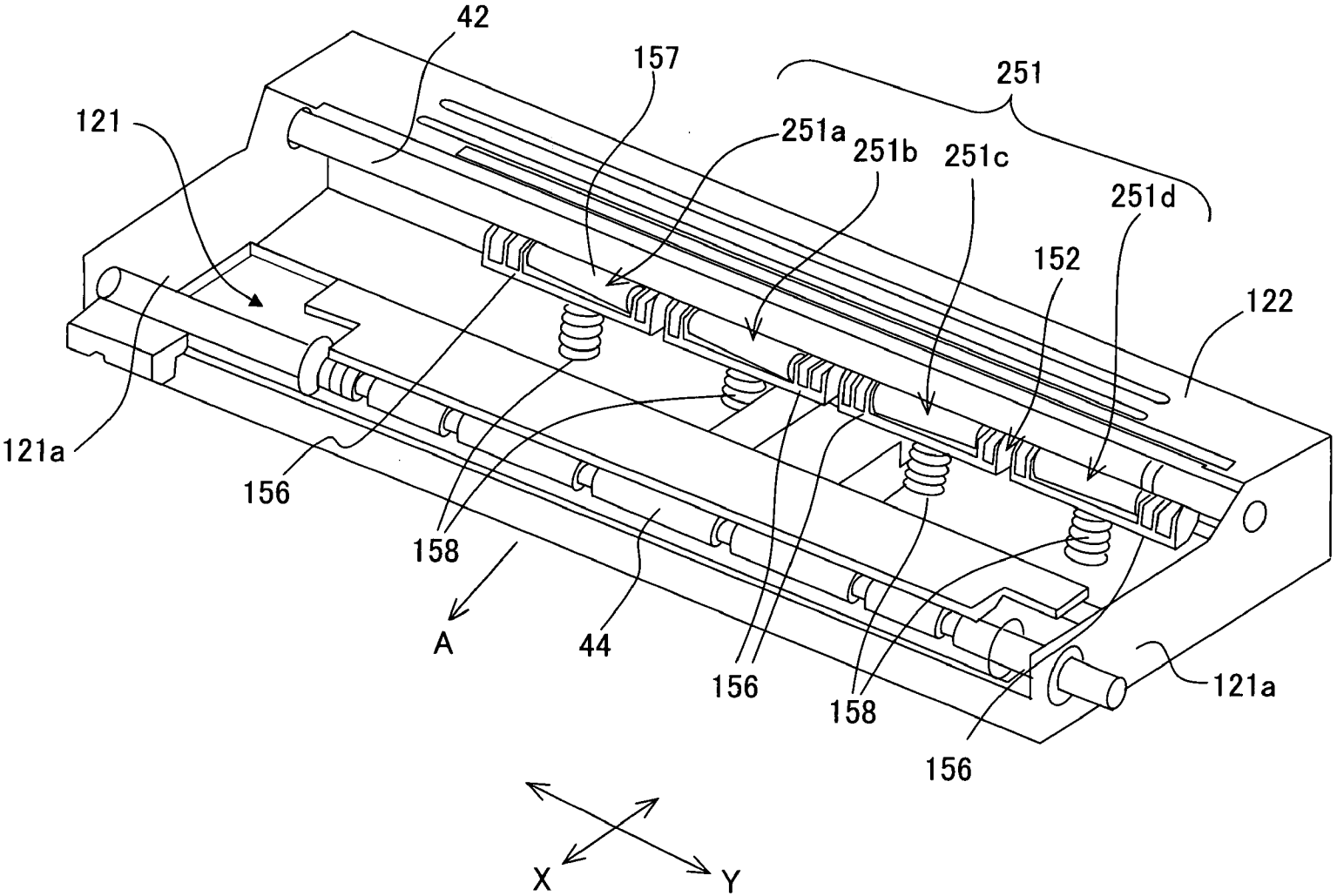
FIG. 9 shows a perspective view illustrating the image-recording apparatus in a state in which a carriage is removed.
Figure 10:
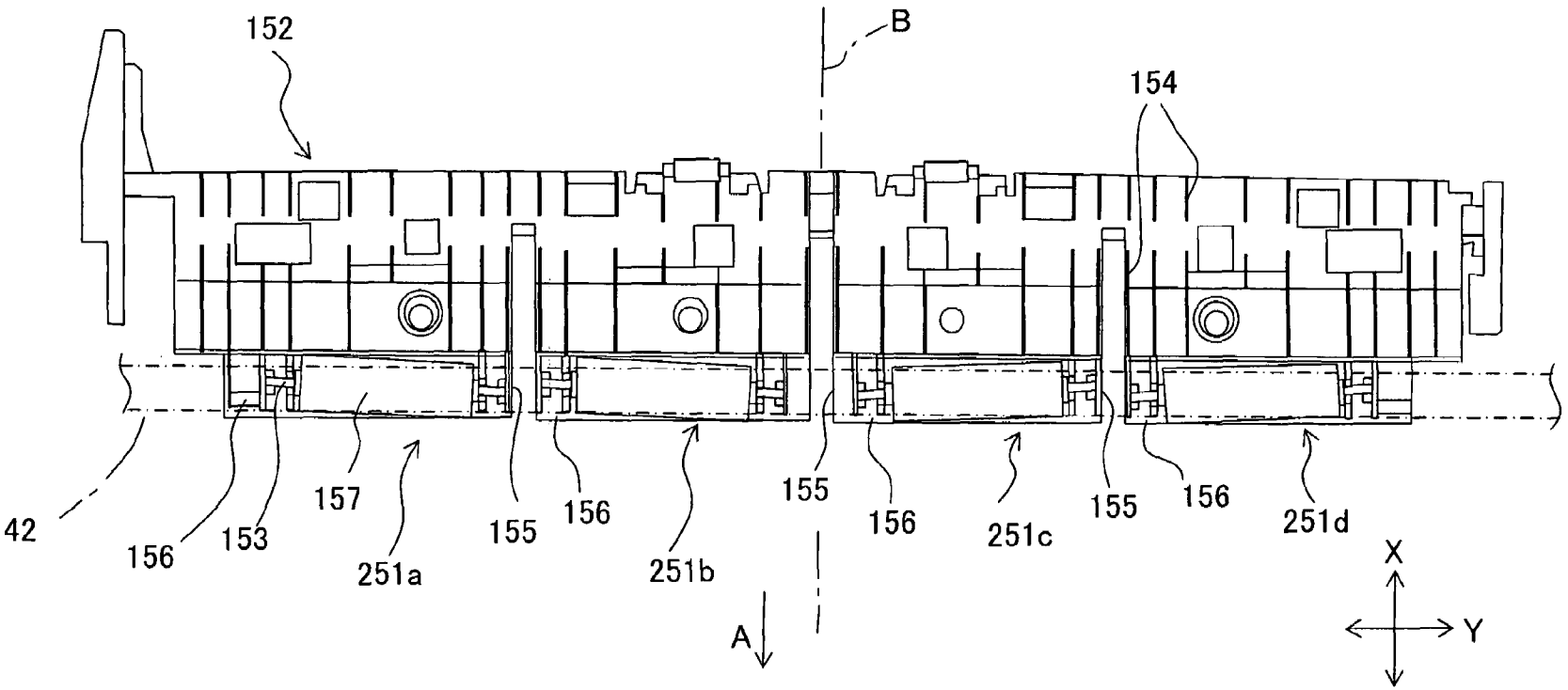
FIG. 10 shows a plan view illustrating a state in which the nip rollers are supported.

A second embodiment of the image-recording apparatus of the present invention will be explained. In this embodiment, a nip roller, which is different from the nip roller described in the first embodiment, is adopted. An image-recording apparatus of this embodiment basically has the same structure as that of the image-recording apparatus of the first embodiment except for the features explained below. As shown in FIG. 9, a driving roller 42 extends in a long form in the direction (Y axis direction) perpendicular to the transport direction. Both ends of the driving roller 42 are rotatably supported by side plates 121*a* of a main frame 121. The driving force is transmitted from a driving source (not illustrated) to drive and rotate the driving roller 42. As shown in FIGS. 9 and 10, a plurality of nip rollers 251 are provided generally in the axial direction of the driving roller 42.

In this embodiment, the four nip rollers 251 are provided (individually designated by symbols of 251*a*, 251*b*, 251*c*, 251*d*). Each of the nip rollers 251 is formed by coating, with a rubber-like elastic member 157, the outer circumference of a cylindrical member made of synthetic resin into which a rotary shaft (support shaft) 153 made of metal is inserted. It is enough that the rubber-like elastic member 157 is arranged at least at the nip position to be formed together with the driving roller 42. It is desirable that the nip roller 251 has such a contour that a predetermined area including the nip position is formed to have an identical diameter in the axial direction. In this embodiment, the rubber-like elastic member is attached continuously in the longitudinal direction of the cylindrical member. Alternatively, for example, the both ends of the cylindrical member may be coated with annular rubber-like elastic members respectively, and a rubber-like elastic member made of a different material may be formed and wound around a central portion of the cylindrical member. On the other hand, the driving roller 42 is formed by coating the surface of the metal shaft, for example, with ceramic particles. The materials of the outer circumferences of the driving roller 42 and the nip roller 251 are not limited to the materials described above, which may be arbitrary materials. For example, the rubber-like elastic member may be applied to the driving roller 42, and the coating of ceramic or the like may be applied to the nip roller 251. Other materials are also available provided that the appropriate nip performance is brought about without causing any slippage or the like in relation to the transport of the printing paper P.

The four nip rollers 251 as described above are arranged in array on an inner guide surface 152 (second transport wall) for constructing the transport passage (feed passage) 23, and they are rotatably supported. The inner guide surface 152 is made of synthetic resin, which is formed in a long form in the direction (Y axis direction) perpendicular to the transport direction. A plurality of protruding ridges 154, which extend in the transport direction, are provided to protrude on the upper surface of the inner guide surface 152. The end edge, which is disposed on the upstream side in the transport direction, is formed to be curved downwardly. The end on the downstream side in the transport direction is divided into four support tab sections 156 by three cutouts 155 which are bored linearly in the transport direction. The respective support tab sections 156 are provided to support the nip rollers 251 individually respectively. The end of the support tab section 156, which is disposed on the downstream side in the transport direction, is formed to have a recessed shape. The nip rollers 251 are attached to the respective support tab sections 156 so that the uppermost end portions thereof have approximately the same height position as that of the forward ends of the protruding ridges 154.

A coil spring 158, which serves as an urging means (urging member) for urging the nip roller 251 toward the driving roller 42, is attached between the main frame 121 and the lower surface of each of the support tab sections 156 corresponding to the position of each of the nip rollers 251. It is possible to reliably urge the respective nip rollers 251 toward the driving roller 42.

Figure 12:
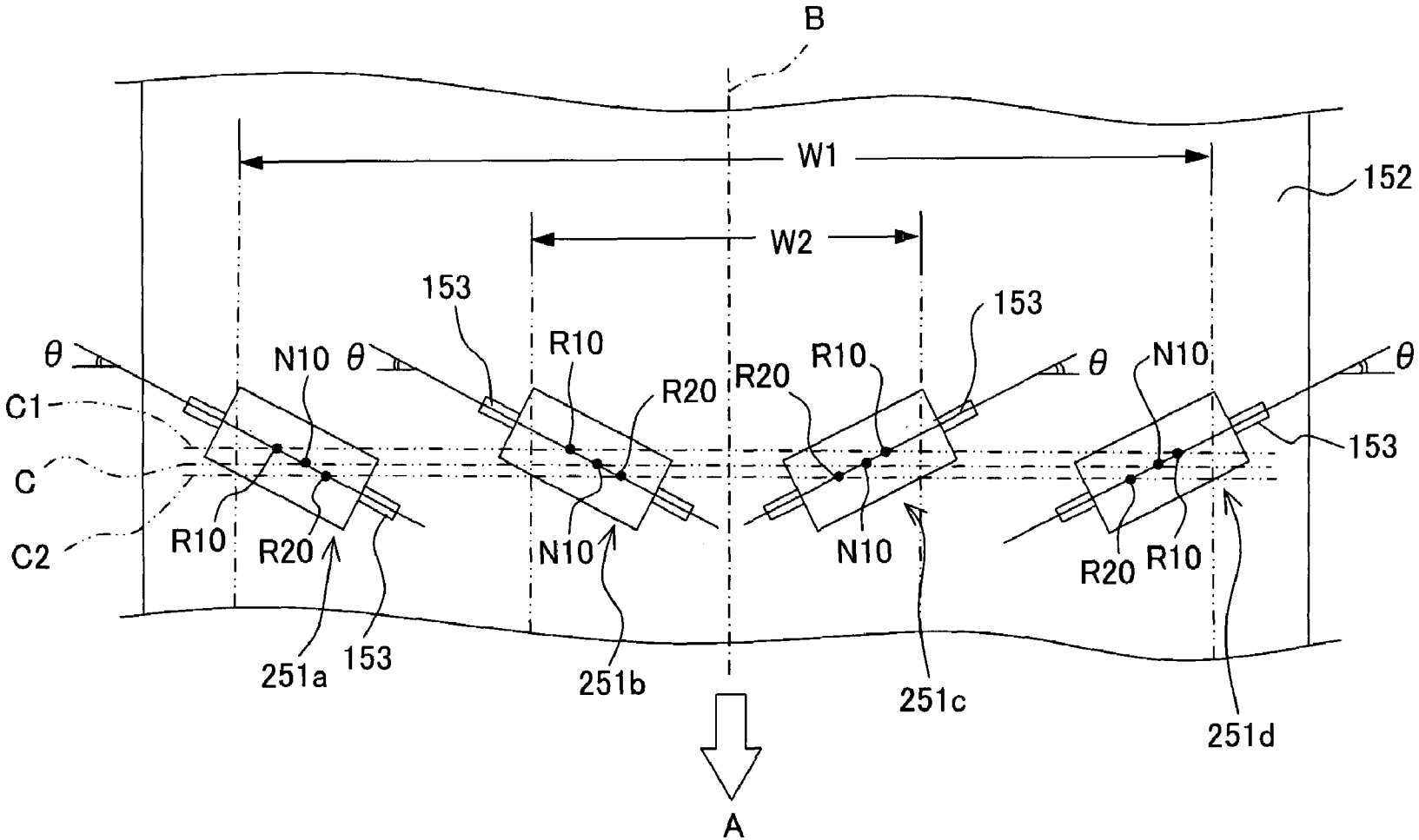
FIG. 12 shows a schematic plan view illustrating the arrangement of nip rollers.

When the nip rollers 251 are attached to the inner guide surface 152, as shown in FIGS. 10 and 12, the end included in the both ends of the rotary shaft 153 of each of the nip rollers 251, which is disposed on the side close to the central portion in the widthwise direction, is supported and inclined to be directed toward the downstream side (in the direction of the arrow A) in the transport direction. The center of the transport passage 23 in the widthwise direction is indicated by the one-dot chain line as the center line B in FIGS. 10 and 12. The nip rollers 251 are arranged such that the nip rollers on the both sides are left-right symmetrical with the boundary of the center line B in the widthwise direction. The nip rollers 251, which are arranged while being inclined in the same direction, have the axes of the rotary shafts 153 which are arranged in parallel to one another in the plane substantially parallel to the transport passage. That is, as shown in the schematic plan view of FIG. 12, the two nip rollers 251*c*, 251*d*, which are positioned on the right side of the center line B, have the rotary shafts 153 which are arranged and inclined upwardly slanting to the right at an angle θ, while the two nip rollers 251*a*, 251*b*, which are positioned on the left side of the center line B, have the rotary shafts 153 which arranged and inclined upwardly slanting to the left at an angle θ. The nip positions N10, which are formed by the nip rollers 251 and the driving roller 42, are positioned on an identical straight line C perpendicular to the transport direction. The straight line C is shown in FIG. 12. The printing paper P has a certain thickness. Therefore, the contact start position R10 of the printing paper P, at which the printing paper P starts the contact with the driving roller 42 and the nip rollers 251, is positioned on the upstream side as compared with the nip positions N10. The contact end position R20 is positioned on the downstream side as compared with the nip positions N10. The four contact start positions R10 with respect to the printing paper P are positioned on an identical straight line C1 perpendicular to the transport direction. The four contact end positions R20 are positioned on an identical straight line C2 perpendicular to the transport direction.

Figure 11:
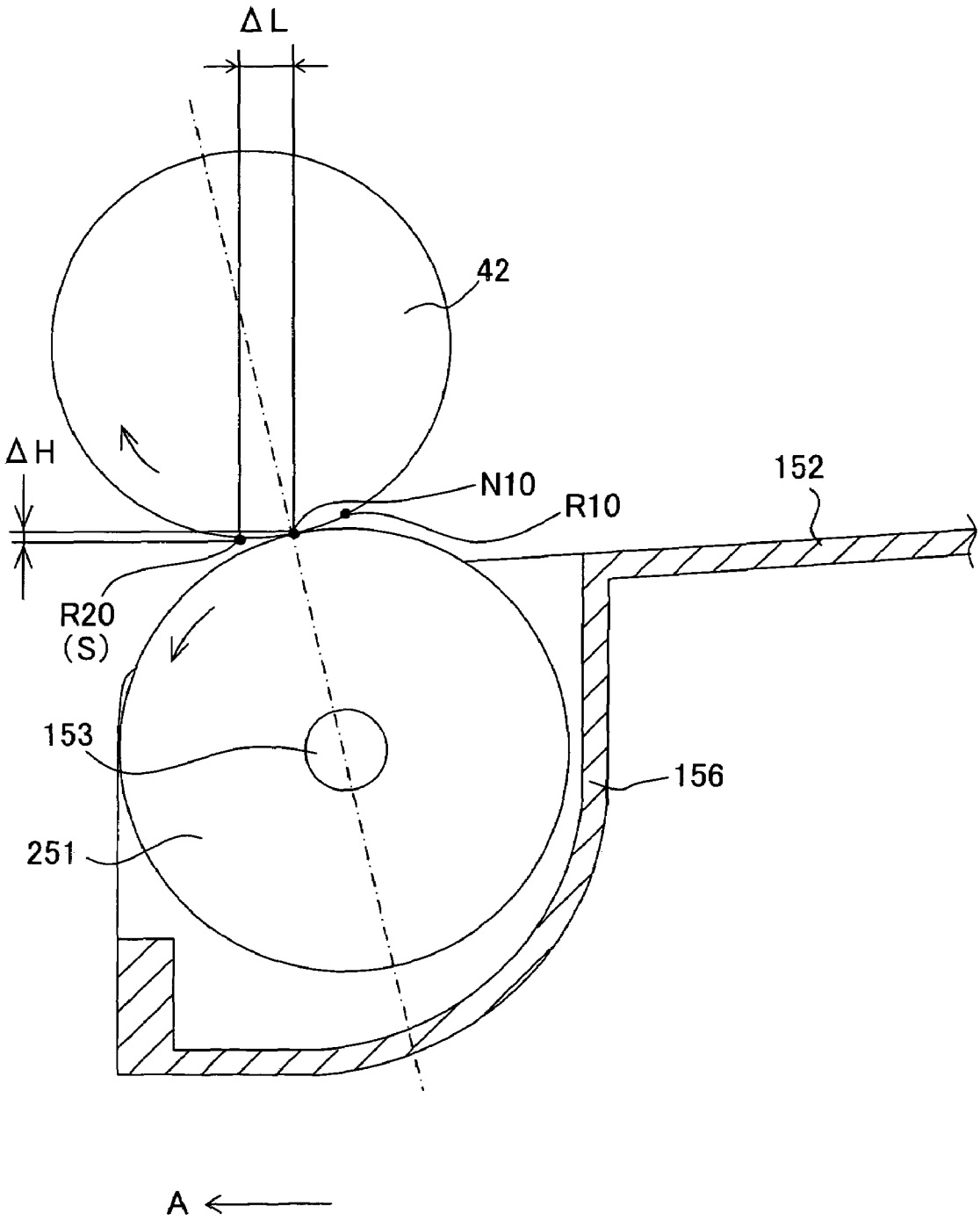
FIG. 11 shows a schematic sectional view illustrating the positional relationship between the driving roller and the nip roller.

As shown in FIG. 11, the nip position N10 for the printing paper P, which is formed by the driving roller 42 and the nip roller 251, is positioned on the upper side by AH with respect to the lowermost end portion S of the outer circumference of the driving roller 42 and on the upstream side by ΔL in the transport direction. The lowermost end portion S of the driving roller 42 is coincident with the contact end position R20 for the printing paper P as described above.

In the case of the image-recording apparatus 1 constructed as described above, as having been explained in relation to FIG. 2, the printing paper P disposed at the uppermost position, which is included in the sheets of the printing paper P stacked in the paper feed cassette 20, is advanced frontwardly in accordance with the rotation of the paper feed roller 25 on the basis of the instruction of the image recording. The forward end of the printing paper P abuts against the inclined separation plate 22, and it is guided by the transport passage 23. The printing paper P undergoes the U-turn from the lower position to the upper position by the aid of the transport passage 23. When the forward end arrives at the straight line C1 shown in FIG. 12, the contact with the driving roller 42 and the nip rollers 251 is started. When the forward end arrives at the straight line C, the printing paper P is interposed by the predetermined urging force.

The rotary shafts 153 of the nip rollers 251 are provided while being inclined with respect to the drive shaft of the driving roller 42. Therefore, the driving roller 42 and the nip rollers 251 make the point-to-point contact. In this embodiment, the printing paper P is interposed at the four nip positions (points) N10. Therefore, the force, which excessively feeds the rearward end of the printing paper P in the transport direction, can be decreased while providing the sufficient nip force between the nip rollers 251 and the driving roller 42, as compared with a case in which the rearward end of the printing paper P is interposed by the long line-to-line contact, and the interposed state is released at once (in the case of the angle θ=0°).

As shown in FIG. 11, the nip position N is positioned on the upper side as compared with the lowermost end position S of the driving roller 42 and on the upstream side in the transport direction. Therefore, the rearward end of the printing paper P is disengaged from the nip position N10 to be free, and then it is guided and advanced downwardly along the curved surface on the lower end side of the driving roller 42 to arrive at the lowermost end position S which is the contact end position R20 for the printing paper P. Therefore, the upward floating is suppressed in this state. Therefore, the printing paper P is transported to the recording section 24 while maintaining the flatness as it is. The gap between the recording head 40 and the printing paper P is maintained to be uniform over the entire surface of the printing paper P. Therefore, there is no fear of the deterioration of the recording quality.

The nip roller 251 is composed of the rubber-like elastic member 157, and the nip roller 252 is urged toward the driving roller 42 at the nip position N10. Therefore, the rubber-like elastic member 157 undergoes the compressive deformation at the nip position N10. Accordingly, strictly speaking, the surface-to-surface contact, which is effected in a curved surface form, is achieved within a slight range. Therefore, when the rearward end of the printing paper P is disengaged from the nip position N, the interposed state, which resides in the surface-to-surface contact in the curved surface form, is gradually released. Therefore, the effect is further enhanced to avoid any excessive transport of the printing paper P.

The effect is synergistically obtained by the fact that the printing paper P is transported along the transport passage 23 while adjusting the center, the nip rollers 251 are arranged in the left-right symmetrical form on the both sides of the center line B of the transport passage 23, and all of the nip positions N10 are arranged on the straight line C. As a result, when the size of the printing paper P in the widthwise direction differs (for example, in each of the cases indicated by W1 and W2 in FIG. 12), the printing paper P is interposed left-right symmetrically on the both sides of the center line B, even when the size is any non-standard size. Therefore, the nip force is uniform in the widthwise direction. The printing paper P can be transported straight without being inclined toward the downward side in the transport direction. Even in the case of any size of the printing paper P, the printing paper P is interposed by the predetermined urging force when the forward end arrives at the straight line C. In other words, even when the printing paper size is changed, the nip position is not deviated in the transport direction. Therefore, any unevenness or dispersion does not arise in the transport condition.

As shown in FIG. 12, the end included in the both ends of the rotary shaft 153 of the nip roller 251, which is disposed on the side of the center line B, is inclined toward the downstream side in the transport direction. In other words, the force is exerted on the printing paper P transported to the nip rollers 251 so that the printing paper P is transported out from the side of the center line B toward the both side edges (outer sides in the widthwise direction) extending in the transport direction of the printing paper P (direction of the arrow A). Therefore, the tensile force acts on the printing paper P so that the printing paper P is pulled toward the both side edges. Accordingly, it is possible to avoid the occurrence of the wrinkle and the bending in the vicinity of the center line B of the printing paper P. The printing paper P can be transported to the recording section 24 while maintaining the printing paper P to be flat.

In this embodiment, the paper feed cassette 20 is arranged at the position lower than the recording section 24. The printing paper P is transported so that the printing paper P is pulled up from the lower position via the U-turn pass. Therefore, it is necessary that the driving roller 42 and the nip rollers 251 interpose the printing paper P with the strong force as compared with a case in which the printing paper P is transported from any upper position to the recording section. The relatively strong urging force is allowed to act on the nip rollers 251. Therefore, the structure, which avoids the phenomenon to excessively feed the rearward end of the printing paper P as described above, provides the extremely large effect in the image-recording apparatus 1 of the type in which the nip force is strong as described above.

Third Embodiment

A third embodiment of the image-recording apparatus of the present invention will be explained. This embodiment adopts a nip roller, a bearing section for the nip roller, and a shaft rotation stop member which are different from those described in the first embodiment. The image-recording apparatus of this embodiment has the same structure as that of the image-recording apparatus of the first embodiment except for the features described below. The driving roller 42 and the nip rollers 151 (driven rollers driven by the driving roller) are provided in the arrangement as explained with reference to FIG. 9, in the same manner as in the second embodiment.

Figure 13:
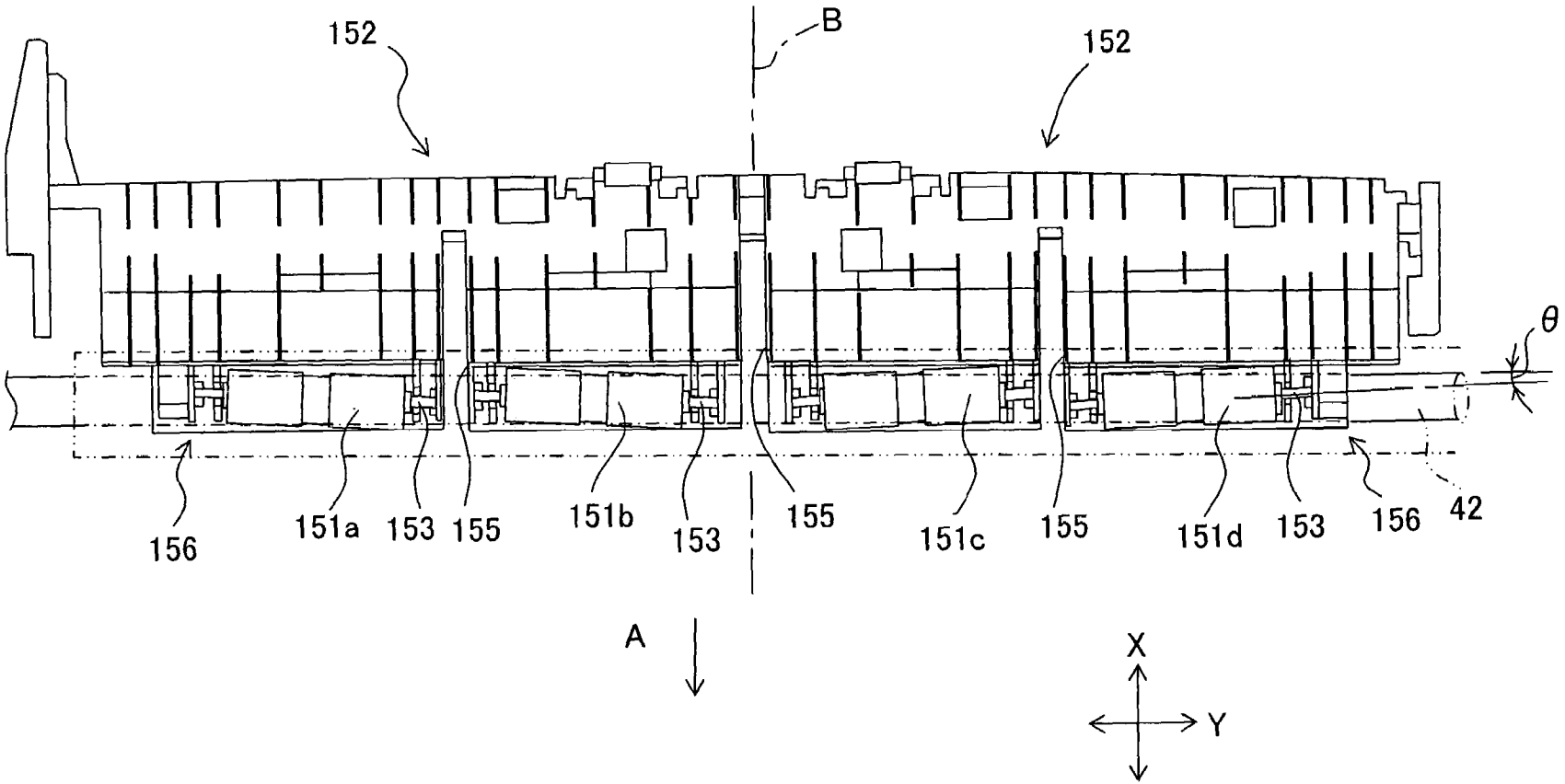
FIG. 13 shows a plan view illustrating an inner guide surface on which the nip rollers are supported.
Figure 14:
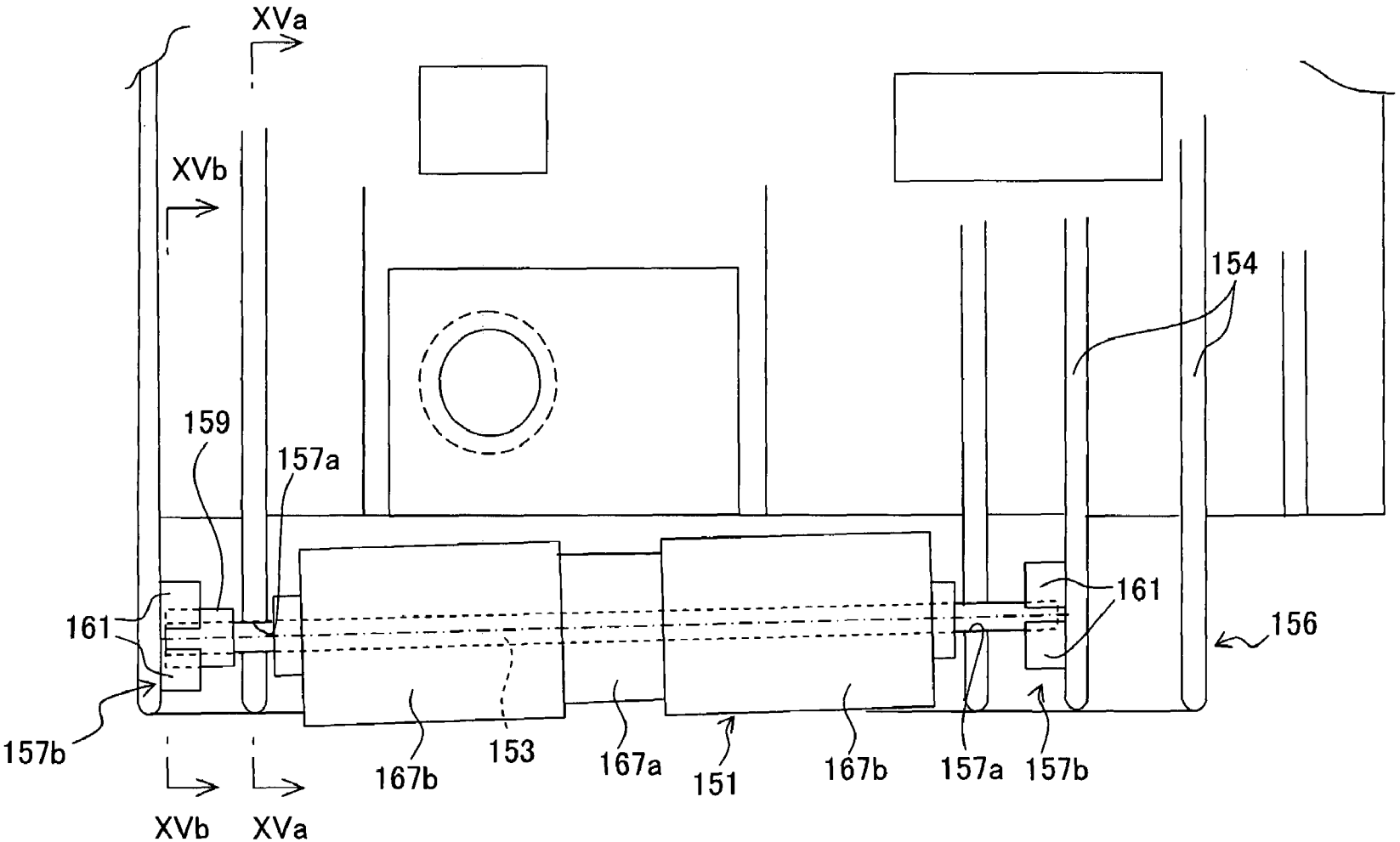
FIG. 14 shows a magnified plan view illustrating a support section for the nip roller based on a shaft rotation stop member of the first embodiment.

As shown in FIGS. 13 and 14, each of the nip rollers 151 is a cylindrical member made of synthetic resin. A central section 167*a*, which is disposed in the axial direction, has a small diameter. Two large diameter sections 167*b*, 167*b*, which are disposed on the both sides of the central section 167*a*, mitigate the overfeed of the printing paper P as the nip sections opposed to the driving roller 42. Each of the nip rollers 151 is rotatably fitted to a support shaft 153 made of metal, which is rotatably supported thereby. A rubber-like elastic member (not illustrated) may be attached continuously in the longitudinal direction of the cylindrical member. Alternatively, for example, annular rubber-like elastic members may be coated on the both end sides of the cylindrical member respectively, and a rubber-like elastic member, which is made of a different material, may be formed and wound around the central portion of the cylindrical member. On the other hand, the driving roller 42 is formed by coating the surface of the metal shaft, for example, with ceramic particles. The materials for the outer circumferences of the driving roller 42 and the nip rollers 151 are not limited to the embodiment described above. For example, a rubber-like elastic member may be applied to the driving roller 42, and the coating with ceramic or the like may be applied to the nip rollers 151. Other materials may be also available provided that the appropriate nip performance is successfully brought about while no slippage or the like is caused in the transport of the printing paper P.

As shown in FIGS. 13 and 14, the four nip rollers 151 are arranged in array for an inner guide surface 152 (second transport wall) as the guide member for constructing the inner side of the transport passage 23, and they are rotatably supported in the same manner as in the first and second embodiments. The inner guide surface 152 is made of synthetic resin, which is formed in a long form in the direction (Y axis direction) perpendicular to the transport direction. A plurality of protruding ridges 154, which extend in the transport direction, are provided to protrude on the upper surface of the inner guide surface 152. The end edge of the inner guide surface 152, which is disposed on the upstream side in the transport direction, is formed to be curved downwardly. The end of the inner guide surface 152 on the downstream side in the transport direction is divided into four support tab sections 156 by three cutouts 155 which are cut out linearly in the transport direction. Open recesses, which are directed upwardly, are formed at the ends of the respective support tab sections 156 on the downstream side in the transport direction. The nip rollers 152 are arranged in the recesses. The bearing sections, which support the both ends of the support shafts 153 of the nip rollers 152 individually respectively, are integrally formed at the both left and right ends of the recesses of the respective support tab sections 156.

Figure 15A:
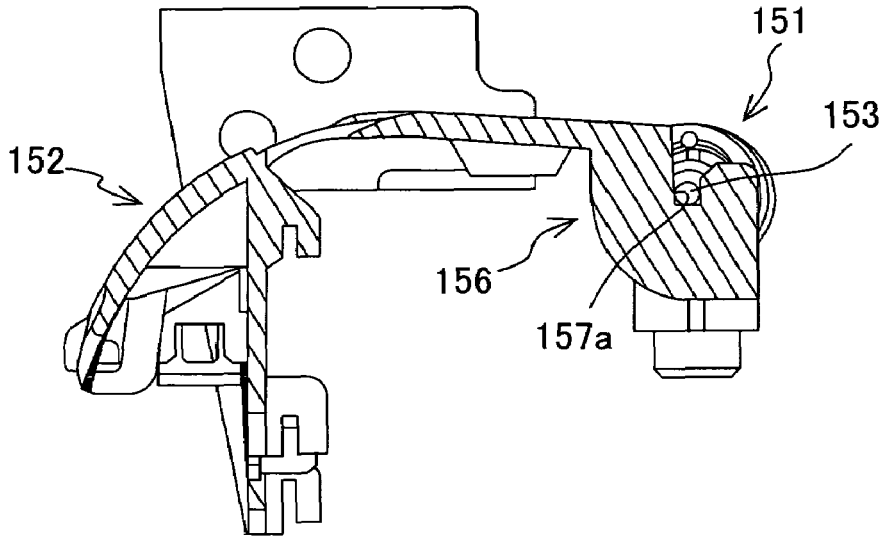
FIG. 15A shows a sectional view taken along a line XVa-XVa shown in FIG. 14.
Figure 15B:
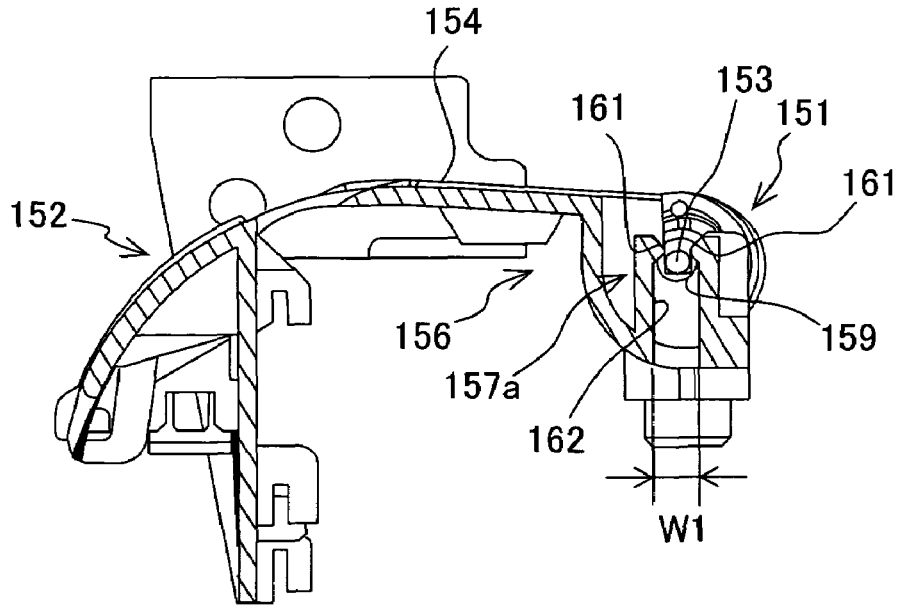
FIG. 15B shows a sectional view taken along a line XVb-XVb shown in FIG. 14.

As shown in FIGS. 14, 15A, and 15B, the bearing section includes a pair of first bearing sections 157*a* which have the same width as the diameter of the support shaft 153, which are open upwardly, which are of a U-shaped groove type, and which are capable of supporting and positioning the upstream side surface and the downstream side surface disposed in the transport direction of the printing paper P, of the outer circumference at the both ends of the support shaft 153, and a pair of second bearing sections 157*b* which support the other side surface (upper side) of the outer circumference at the both ends of the support shaft 153 so that any disengagement cannot be caused. The nip roller 151 is arranged between the pair of first bearing sections 157*a*. The second bearing sections 157*b* are formed outside the pair of first bearing sections 157*a*. As shown in FIG. 15B, a pair of fastening pawls 161 are formed at the upper ends of the second bearing sections 157*b*. Open grooves 162, which have a widthwise dimension of W1 and which are directed downwardly, are formed below the pair of fastening pawls 161.

As shown in FIG. 14, a pipe-shaped shaft rotation stop member 159 is fitted to at least one end of the support shaft 153. The shaft rotation stop members 159 are restricted by the pair of fastening pawls 161 of the second bearing sections 157*b*. The shaft rotation stop member 159 is composed of a highly frictional member made of synthetic resin, which is, for example, a thermoplastic elastomer (rubber-like elastic member). The shaft rotation stop member 159 is tightened and fitted to the support shaft 153 by a tight fit. Therefore, the shaft rotation stop member 159 is not easily disengaged from the support shaft 153. The shaft rotation stop member 159 is not rotated relatively with respect to the support shaft 153 as well. The outer circumferential surface of the shaft rotation stop member 159 may be circular. However, when the outer circumferential diameter of the shaft rotation stop member 159 is formed to be slightly larger than the widthwise direction W1 of the open groove 162, the shaft rotation stop member 159 can be tightly fastened to and restricted by the open groove 162. As for the outer circumferential surface of the shaft rotation stop member 159, projections may be provided on the circular outer circumferential surface, or the outer circumferential surface may be formed into a polygonal outer circumferential surface so that the shaft rotation stop member 159 is easily fastened by the pair of fastening pawls 161 and between the open groove 162.

Figure 16:
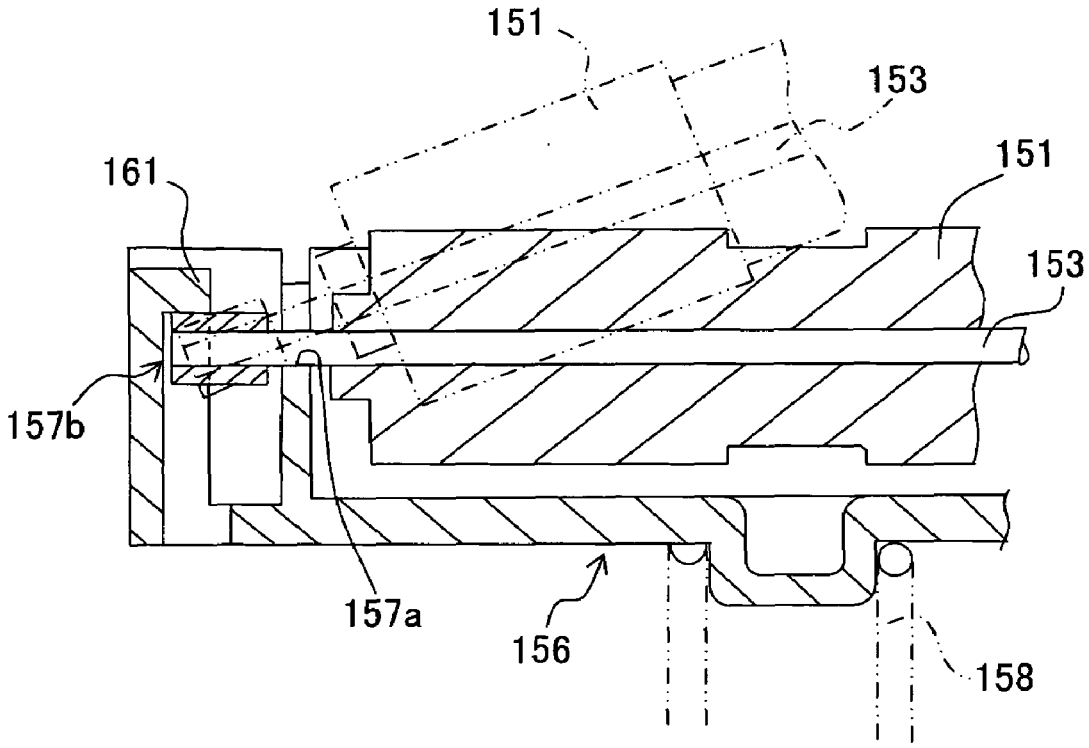
FIG. 16 shows a schematic sectional view illustrating the operation for attaching the nip roller.

When the nip roller 151 is installed, the following procedure is adopted as shown by two-dot chain lines in FIG. 16. That is, one end of the support shaft 153, to which the shaft rotation stop member 159 has been attached, is directed obliquely downwardly together with the nip roller 151, which is inserted into a lower portion of the open groove 162 between one first bearing section 157*a* and the second bearing section 157*b*. Subsequently, when the support shaft 153 is allowed to be in a horizontal state, the one end of the support shaft 153 is rotatably supported by the U-shaped groove of one first bearing section 157*a*. The upper surface side of the shaft rotation stop member 159, which is disposed on the forward end side as compared with the one end, is strongly restricted by the pair of fastening pawls 161, and any disengagement cannot be caused. The other end of the nip roller 151 is rotatably supported by the other first bearing section 157*a* and the second bearing section 157*b*. The support shaft 153 cannot be rotated relatively with respect to the shaft rotation stop member 159, and the nip roller 151 can be rotated relatively with respect to the support shaft 153. Therefore, when the printing paper P is nipped between the driving roller 42 and the nip rollers 151, and the driving roller 42 is driven and rotated, then the support shaft 153 is not rotated, and only the nip rollers 151 are rotated.

The height positions of the U-shaped grooves of the pair of first bearing sections 157*a* are adjusted so that the uppermost end portions on the both left and right sides of the nip roller 151 have approximately the same height as that of the forward ends of the protruding ridges 154 formed on the inner guide surface 152.

Coil springs 158, which serve as the means for urging the nip rollers 151 toward the driving roller 42, are provided between the main frame 121 and the lower surfaces of the respective support tab sections 156 corresponding to the positions of the respective nip rollers 151 respectively. Each of the nip rollers 151 can be reliably urged toward the driving roller 42. As described above, the shaft rotation stop member 159 is fitted to at least one end of the support shaft 153 of each of the nip rollers 151. The shaft rotation stop member 159 is fastened so that the shaft rotation stop member 159 cannot be rotated and cannot be disengaged upwardly with respect to the second bearing section 157*b*. Further, the support shaft 153 is installed to the shaft rotation stop member 159 so that the support shaft 153 cannot be rotated relatively with respect to the shaft rotation stop member 159. Therefore, the support shaft 153 cannot be rotated relatively with respect to the second bearing section 157*b*. Only the nip rollers 151 can be rotated together with the driving roller 42. Therefore, any inconvenience such as the backlash and the occurrence of any error in the support height of the nip roller 151 is not caused, which would be otherwise caused by cutting and scraping the bearing section, for example, when a support shaft made of metal is rotated with respect to a bearing section made of synthetic resin as in the conventional technique.

Fourth Embodiment

Figures 17A, 17B, 17C:
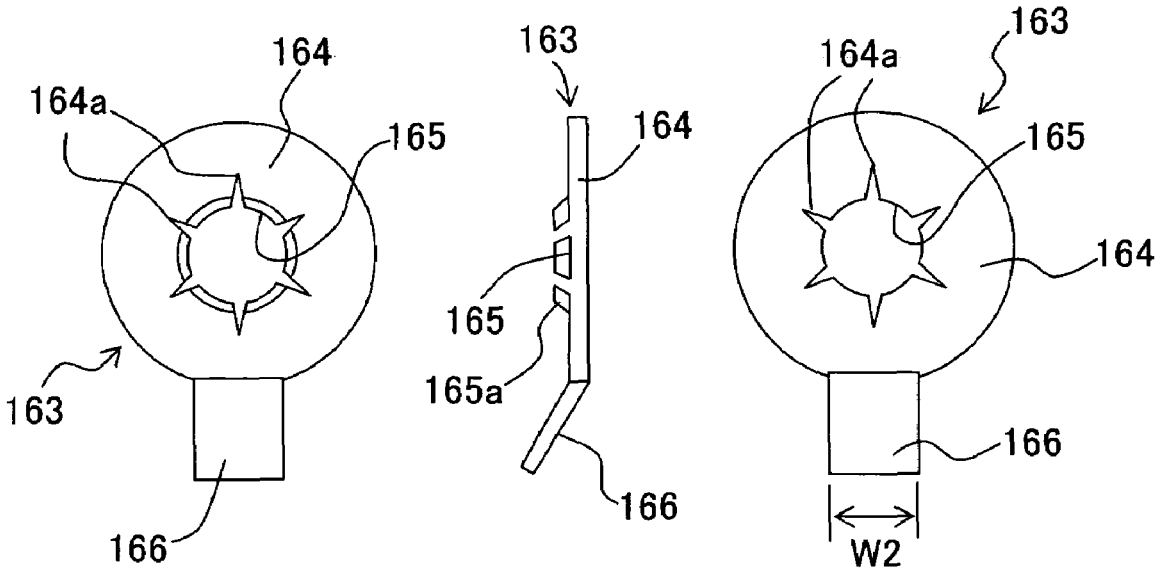
FIG. 17A shows a back view illustrating a shaft rotation stop member according to the second embodiment.
FIG. 17B shows a side view thereof.
FIG. 17C shows a front view thereof.
Figure 18:
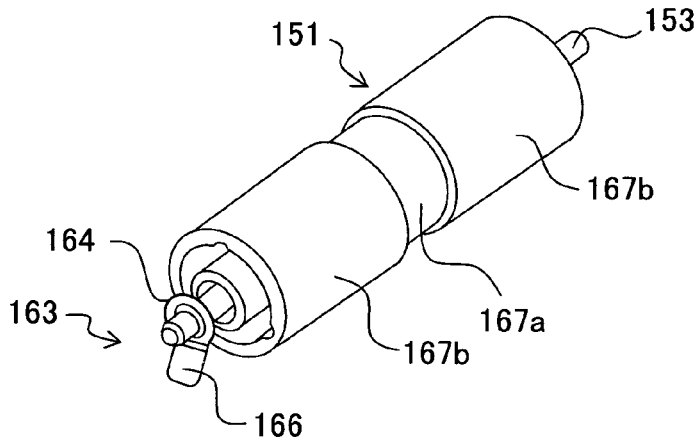
FIG. 18 shows a perspective view illustrating a state in which the shaft rotation stop member of the second embodiment is attached to a support shaft.

A shaft rotation stop member 163 according to a fourth embodiment shown in FIGS. 17 to 19 is made of metal, and it has a flat shape. As shown in FIGS. 17A to 17C, the shaft rotation stop member 163 includes an annular main body 164 which is formed with an insertion hole 165 for fitting the support shaft 153 thereto, and a tongue 166 which extends from a part of the outer circumference of the main body 164. As shown in FIG. 17B, the tongue 166 extends obliquely with respect to the surface of the main body. A plurality of cutout grooves 164*a*, which are communicated with the insertion hole 165, are provided radially for the main body 164. A plurality of projections 165*a*, which are separated in the circumferential direction, are formed. The projections 165*a* (circumferential surface portions of the insertion hole 165) protrude slightly inwardly from the flat surface of the main body 164. When the projections 165*a* are fitted to the support shaft 153, they have elasticity. As shown in FIG. 17A, the tongue 166, which extends from the main body 164, is formed so as to have a widthwise dimension W2 (<W1 (see FIG. 15B)) which is in an extent of being fitted to the open groove 162 having the widthwise direction W1 of the second bearing section 157*b*.

Figure 19A:
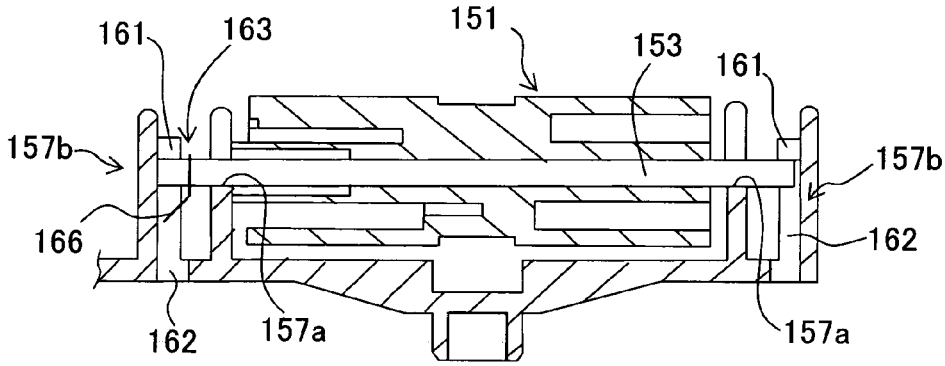
FIG. 19A shows a sectional view illustrating a support section for the nip roller.
Figure 19B:
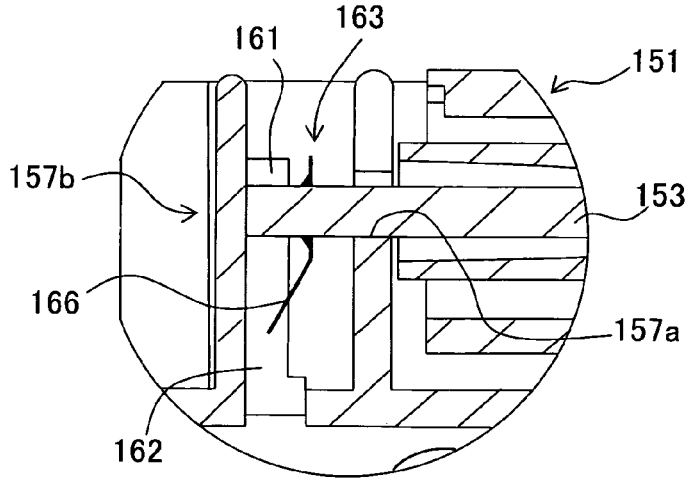
FIG. 19B shows a magnified sectional view thereof.

An explanation will be made below about a method for attaching the shaft rotation stop member 163 to the nip roller 151 and a method for attaching the nip roller 151 to the bearing section. As shown in FIGS. 18, 19A, and 19B, one end of the support shaft 153 of the nip roller 151 is inserted into the insertion hole 165 of the shaft rotation stop member 163, and the tongue 166 is arranged downwardly. In the same manner as in the third embodiment, one end of the support shaft 153 to which the attachment of the shaft rotation stop member 163 has been attached is directed obliquely downwardly together with the nip roller 151, which is inserted into the lower side of the open groove 162 between the second bearing section 157*b* and the first bearing section 157*a* disposed on one side. Subsequently, the support shaft 153 is allowed to be in a horizontal state. Accordingly, the one end of the support shaft 153 is rotatably supported by the U-shaped groove of one first bearing section 157*a* disposed on one side. The main body 164 of the shaft rotation stop member 163, which is disposed on the forward end side from the one end, is positioned between the first bearing section 157*a* and the second bearing section 157*b*. The tongue 166 is fitted into the open groove 162. The other end of the nip roller 151 is rotatably supported by the second bearing section 157*b* and the first bearing section 157*a* disposed on the other side.

Accordingly, the main body 164 of the shaft rotation stop member 163 is installed to the support shaft 153 so that the rotation cannot be effected relatively to one another. Further, the tongue 166 is fitted into the open groove 162. Therefore, the support shaft 153 cannot be rotated with respect to the second bearing section 157*b*, which is fastened by the pair of fastening pawls 161 so that the disengagement cannot be effected upwardly (incapable of being disengaged). Therefore, the nip roller 151 is rotatable in a predetermined posture independently from the support shaft.

Any one of the shaft rotation stop member 159 of the third embodiment and the shaft rotation stop member 163 of the fourth embodiment is constructed to have the simple structure in which each of the members 159, 163 is merely fitted to the support shaft 153. It is unnecessary to apply any forming processing or machining to the support shaft, and the production cost is not increased so much. The operation for incorporating the nip roller 151 as well as the support shaft 153 into the bearing section is also performed such that one end portion of the support shaft 153 on the side of the attachment of the shaft rotation stop member 159, 163 is first fitted to the second bearing section 157*b*. Therefore, an effect is also obtained such that the incorporating operation performance is satisfactory. The first bearing section 157*a* may be long hole-shaped. In this arrangement, the support shaft 153 is inserted into the long hole, and then the shaft rotation stop member 159, 163 is fitted to the support shaft 153, after which the shaft rotation stop member 159, 163 is fitted into the second bearing section 157*b*.

When the nip roller 151 is attached to the inner guide surface 152, as shown in FIG. 13, the nip roller 151 is supported in an inclined manner so that the end, which is disposed on the side near to the central portion in the widthwise direction and which is included in the both ends of the rotary shaft 153 of the nip roller 151 as viewed in the plan view, is directed toward the downstream side (in the direction of the arrow A) in the transport direction. In FIG. 13, the central portion of the transport passage 23 in the widthwise direction is indicated by the one-dot chain line as the center line B. The nip rollers 151 are arranged in the left-right symmetrical form on the both sides with the boundary of the center line B in the widthwise direction. The nip rollers 151, which are arranged while being inclined in the identical direction, are arranged such that the axes of the support shafts 153 thereof are parallel to one another in the plane substantially parallel to the transport passage. That is, as shown in FIG. 13, the two nip rollers 151*c*, 151*d*, which are positioned on the right side of the center line B, have the support shafts 153 which are arranged while being inclined upwardly slanting to the right at the angle θ. On the other hand, the two nip rollers 151*a*, 151*b*, which are positioned on the left side of the center line B, have the support shafts 153 which are arranged while being inclined upwardly slanting to the left at the angle θ.

The image-recording apparatus 1 constructed as described above is operated as follows. That is, the printing paper P, which is disposed at the uppermost position of the sheets of the printing paper P stacked in the paper feed cassette 20, is advanced frontwardly in accordance with the rotation of the paper feed roller 25 on the basis of the instruction of the image recording. The forward end of the printing paper P abuts against the inclined separation plate 22, and it is guided by the transport passage 23. The printing paper P undergoes the U-turn from the lower position to the upper position along the transport passage 23. The forward end edge thereof abuts against the contact portions between the driving roller 42 and the nip rollers 151. In the state in which the paper feed is started, the driving roller 42 is rotated in the direction (counterclockwise direction in FIG. 4) opposite to the printing paper transport direction. Therefore, the printing paper P is subjected to the correction so that the forward end edge of the transported printing paper P is in the direction perpendicular to the transport direction. Subsequently, when the driving roller is rotated in the printing paper transport direction (clockwise direction in FIG. 4), the printing paper P is interposed and transported by the driving roller 42 and the nip rollers 151 by the interposing forces of the coil springs 158.

The support shafts 153 of the nip rollers 151 are provided while being inclined with respect to the drive shaft of the driving roller 42. Therefore, the driving roller 42 and the nip rollers 151 make the point-to-point contact with each other. In this embodiment, the printing paper P is interposed at the four nip positions (points). Therefore, the force, which excessively feeds the rearward end of the printing paper P in the transport direction, can be weakened even when the sufficient nip force is provided between the nip rollers 151 and the driving roller 42, as compared with a case in which the rearward end of the printing paper P is interposed in accordance with the long line-to-line contact, and the interposed state is released at once.

The effect is synergistically obtained by the fact that the printing paper P is transported along the transport passage 23 while adjusting the center, and the nip rollers 151 are arranged in the left-right symmetrical form on the both sides of the center line B of the transport passage 23. As a result, when the size of the printing paper P in the widthwise direction differs (for example, in each of the cases indicated by W1 and W2 in FIG. 12), the printing paper P is interposed left-right symmetrically on the both sides of the center line B, even when the size is any non-standard size. Therefore, the nip force is uniform in the widthwise direction. The printing paper P can be transported straight without being inclined toward the downward side in the transport direction. Even in the case of any size of the printing paper P, the printing paper P is interposed by the predetermined urging force when the forward end arrives at the nip position. In other words, even when the printing paper size is changed, the nip position is not deviated in the transport direction. Therefore, any unevenness or dispersion does not arise in the transport condition.

As shown in FIG. 13, the end included in the both ends of the rotary shaft 153 of the nip roller 151, which is disposed on the side of the center line B, is inclined and directed toward the downstream side in the transport direction. In other words, the force is exerted on the printing paper P transported by the nip rollers 151 so that the printing paper P is transported out from the side of the center line B toward the both side edges (outer sides in the widthwise direction) extending in the transport direction of the printing paper P (direction of the arrow A). Therefore, the tensile force acts on the printing paper P to be pulled toward the both side edges. Accordingly, it is possible to avoid the occurrence of the wrinkle and the bending in the vicinity of the center line B of the printing paper P. The printing paper P can be transported to the recording section 24 while maintaining the printing paper P to be flat.

In this embodiment, the paper feed cassette 20 is arranged at the position lower than the recording section 7. The printing paper P is transported so that the printing paper P is pulled up from the lower position via the U-turn pass. Therefore, it is necessary that the driving roller 42 and the nip rollers 151 interpose the printing paper P with the strong force as compared with a case in which the printing paper P is transported from any upper position to the recording section. The relatively strong urging forces are allowed to act on the nip rollers 151. Therefore, it is possible to provide the large effect in which the phenomenon to excessively feed the rearward end of the printing paper P is avoided as described above, in the image-recording apparatus 1 of the form in which the nip force is strong as described above.

The present invention is also applicable to such a structure that the driving roller 42 of the present invention is arranged on the lower side of the transport passage, and the nip rollers 151 are arranged on the upper side with the printing paper P intervening therebetween, while the support tab section 154 and the bearing section are provided on the first transport wall 160 on the outer side, and the nip rollers 151 are pressed and urged downwardly by the coil springs 158.

The embodiments described above merely illustrate the present invention by way of example. Various modifications and improvements may be made within a scope of the present invention. For example, the nip roller, which has the shape as explained in the first embodiment, can be adopted in the second embodiment. Further, the nip roller, which has the shape as explained in the first or second embodiment, can be adopted in the third embodiment. The bearing mechanism for the nip roller explained in the third or fourth embodiment may be used in the first and second embodiments.

What is claimed is:

1. An image-recording apparatus which records an image on a recording medium, the image-recording apparatus comprising:

an image-recording section configured to record the image on the recording medium;

a transport passage configured to transport the recording medium to the image-recording section; and a driving roller and a plurality of nip rollers which are provided on the transport passage respectively to interpose and transport the recording medium, wherein:

shafts of the plurality of nip rollers are arranged substantially along a drive shaft of the driving roller under the driving roller, the shafts being inclined toward a downstream side in a transport direction of the recording medium with respect to the drive shaft of the driving roller; and nip positions for the recording medium, which are formed by the nip rollers and the driving roller, are positioned above and upstream, in the transport direction, from a lowermost end portion of an outer circumference of the driving roller.

2. The image-recording apparatus according to claim 1, wherein one of both ends of each of the shafts of the nip rollers, which is disposed on a side close to a substantially central portion of the transport passage in a widthwise direction perpendicular to the transport direction, is arranged to incline so that the one end is positioned in a downstream of the other end in the transport direction.

3. The image-recording apparatus according to claim 1, wherein the nip rollers are arranged to be symmetrical with respect to a substantially central portion in a widthwise direction of the transport passage.

4. The image-recording apparatus according to claim 1, wherein each of the nip rollers has such a contour that a predetermined area, which includes the nip position in an axial direction of the nip roller, is formed to have an identical diameter.

5. The image-recording apparatus according to claim 1, wherein a rubber-like elastic member is formed at least at the nip position at least on one of an outer circumference of the driving roller and outer circumferences of the nip rollers.

6. The image-recording apparatus according to claim 3, wherein at least two nip rollers of the nip rollers are arranged to incline in an identical direction, and axes of the shafts of the at least two nip rollers are arranged in parallel in a plane substantially parallel to the transport passage.

7. The image-recording apparatus according to claim 3, wherein the recording medium is transported such that a substantially central portion in a widthwise direction of the recording medium is positionally adjusted to the substantially central portion in the widthwise direction of the transport passage.

8. The image-recording apparatus according to claim 6, wherein the nip positions, which are formed by the driving roller and the nip rollers arranged to incline in the identical direction, are positioned on an identical straight line extending perpendicularly to the transport direction.

9. The image-recording apparatus according to claim 1, wherein the recording medium is transported to the nip positions via a U-turn transport passage from a position lower than the nip positions.

10. The image-recording apparatus according to claim 1, wherein a recessed cutout is formed on each of the nip rollers, and nip sections, which make contact with the driving roller under pressure respectively, are formed on both sides of the recessed cutout in an axial direction respectively.

11. The image-recording apparatus according to claim 10, wherein:

the driving roller is driven intermittently by a predetermined unit of transport distance at least when the recording medium is transported while being interposed at portions disposed in the vicinity of a rearward end of the recording medium; and a spacing distance in the transport direction between the respective nip positions, at which the respective nip sections of the respective nip rollers and the driving roller make contact under pressure, is not less than the unit of transport distance.

12. The image-recording apparatus according to claim 10, wherein the respective nip sections of the respective nip rollers have an identical diameter.

13. The image-recording apparatus according to claim 10, wherein the nip positions, at which the nip sections of the nip rollers and the driving roller make contact under pressure, include an upstream side nip position group and a downstream side nip position group in the transport direction, nip positions, which are included in the upstream side nip position group, are positioned on a first straight line perpendicular to the transport direction, and nip positions, which are included in the downstream side nip position group, are positioned on a second straight line perpendicular to the transport direction.

14. The image-recording apparatus according to claim 10, wherein the respective nip rollers are arranged, corresponding to sizes of various recording media to be transported, in the vicinity of both ends in a widthwise direction of the recording media.

15. The image-recording apparatus according to claim 10, wherein the nip rollers are arranged left-right symmetrically with respect to a center of the transport passage in a widthwise direction.

16. The image-recording apparatus according to claim 10, wherein each of the shafts of the respective nip rollers is arranged to incline so that one end, which is disposed on a side of a center in a widthwise direction of the transport passage, is positioned in a downstream of the other end in the transport direction.

17. The image-recording apparatus according to claim 10, wherein the upstream side of the transport passage from the driving roller and the nip rollers guides the recording medium to the nip positions from a position below the nip positions formed by the driving roller and the nip rollers.

18. The image-recording apparatus according to claim 17, wherein the transport passage guides the recording medium by subjecting the recording medium to an U-turn from a lower position to an upper position.

19. The image-recording apparatus according to claim 10, wherein the image-recording section includes an ink-jet recording head configured to record the image by discharging an ink.

20. The image-recording apparatus according to claim 10, wherein only one nip roller is provided for the shaft thereof.

21. The image-recording apparatus according to claim 10, wherein the recessed cutout of the nip roller is a cylindrical groove which is perpendicular to the axial direction of the nip roller.

22. The image-recording apparatus according to claim 10, wherein the recessed cutout of the nip roller is a groove which is formed obliquely with respect to the axial direction of the nip roller.

23. The image-recording apparatus according to claim 1, further comprising:

support shafts each of which rotatably supports one of the nip rollers; and bearing sections which support both ends of each of the support shafts and which include a first bearing section which supports an upstream side portion and a downstream side portion, in the transport direction of the recording medium, of an outer circumferential surface disposed at the both ends of the support shaft, and a second bearing section which supports the both ends of the support shaft to prevent any disengagement, wherein:

a shaft rotation stop member is fitted to cover at least one end of the support shaft, and the shaft rotation stop member is restricted by the second bearing section.

24. The image-recording apparatus according to claim 23, wherein the shaft rotation stop member has a shape to be tightly fitted to the support shaft.

25. The image-recording apparatus according to claim 23, wherein:

the first bearing section is disposed on a side close to an end surface of the nip roller, the second bearing section is arranged on a side far from the end surface of the nip roller with the first bearing section intervening therebetween; and the second bearing section includes a pair of fastening pawls which fasten the shaft rotation stop member.

26. The image-recording apparatus according to claim 23, wherein the first bearing section and the second bearing section are integrally formed in a guide member which constructs the transport passage.

27. The image-recording apparatus according to claim 23, wherein the nip roller and the shaft rotation stop member are composed of synthetic resin materials, and the support shaft is made of metal.

28. The image-recording apparatus according to claim 27, wherein the shaft rotation stop member is made of a material which has high friction with respect to the support shaft.

29. The image-recording apparatus according to claim 23, wherein:

the shaft rotation stop member has a flat shape and is made of metal provided with an insertion hole capable of inserting the support shaft thereinto; and a plurality of annular projections, which are bent inwardly, are arranged for the insertion hole, and forward ends of the respective projections reach an outer circumferential surface of the support shaft so that the forward ends are tightly fitted to the support shaft.

30. The image-recording apparatus according to claim 29, wherein the shaft rotation stop member has a flat shape and is made of metal, and the shaft rotation stop member has a tongue which is fitted to an open groove of the second bearing section to stop rotation of the support shaft.

31. The image-recording apparatus according to claim 23, wherein one of both ends of each of the support shafts of the plurality of nip rollers, which is disposed on a side close to a substantially central portion in a widthwise direction perpendicular to the transport direction of the transport passage, is arranged to incline so that the one end is positioned in a downstream of the other end in the transport direction.

32. The image-recording apparatus according to claim 31, wherein the nip rollers are arranged left-right symmetrically with respect to the substantially central portion in the widthwise direction of the transport passage.

33. The image-recording apparatus according to claim 1, further comprising a paper feed cassette, and a paper feed unit configured to feed the recording media in the paper feed cassette to the transport passage.

* * * * *